US011047194B2

(12) United States Patent
Fathi et al.

(10) Patent No.: US 11,047,194 B2
(45) Date of Patent: Jun. 29, 2021

(54) METHOD AND SYSTEM FOR REMOVING IRON-CONTAINING CASING FROM A WELL BORE

(71) Applicant: STATOIL PETROLEUM AS, Stavanger (NO)

(72) Inventors: Marcus Fathi, Stavanger (NO); Siddhartha Francois Lunkad, Stavanger (NO)

(73) Assignee: STATOIL PETROLEUM AS, Stavanger (NO)

( * ) Notice: Subject to any disclaimer, the term of this patent is extended or adjusted under 35 U.S.C. 154(b) by 58 days.

(21) Appl. No.: 15/513,082

(22) PCT Filed: Sep. 18, 2015

(86) PCT No.: PCT/NO2015/050166
§ 371 (c)(1),
(2) Date: Mar. 21, 2017

(87) PCT Pub. No.: WO2016/048158
PCT Pub. Date: Mar. 31, 2016

(65) Prior Publication Data

US 2017/0241226 A1 Aug. 24, 2017

(30) Foreign Application Priority Data

Sep. 22, 2014 (GB) ..... 1416675
Aug. 26, 2015 (GB) ..... 1515127

(51) Int. Cl.
*E21B 29/02* (2006.01)
*E21B 33/12* (2006.01)
(Continued)

(52) U.S. Cl.
CPC ..... *E21B 29/02* (2013.01); *E21B 33/12* (2013.01); *E21B 33/13* (2013.01); *E21B 43/40* (2013.01); *E21B 47/00* (2013.01)

(58) Field of Classification Search
CPC ..... E21B 29/02
See application file for complete search history.

(56) References Cited

U.S. PATENT DOCUMENTS 2,152,306 A * 3/1939 Grebe ..... C09K 8/528 166/376
2,261,292 A * 11/1941 Salnikov ..... E21B 29/02 166/291
(Continued)

FOREIGN PATENT DOCUMENTS

RU 2227201 C2 4/2004
RU 2 370 625 C1 10/2009
(Continued)

OTHER PUBLICATIONS

Combined Search and Examination Report for Application No. GB 1416675.5 dated Dec. 24, 2014.
(Continued)

*Primary Examiner* — Steven A MacDonald
(74) *Attorney, Agent, or Firm* — Birch, Stewart, Kolasch & Birch, LLP

(57) ABSTRACT

There is provided a method of chemically removing iron-containing casing from a well bore comprising injecting an acidic solution into said well bore, wherein said solution contacts said iron-containing casing and thereby accelerates oxidation of iron to iron cations, allowing said iron cations to dissolve in said solution, and removing said solution from said well bore. There is further provided a batch method of removing iron-containing casing from a well bore comprising injecting an acidic solution into said well bore, wherein said acidic solution contacts said iron-containing casing and
(Continued)

thereby accelerates oxidation of iron to iron cations, and allowing said iron cations to dissolve in said acidic solution, wherein said well bore is at least partially open to the atmosphere.

32 Claims, 13 Drawing Sheets

(51) Int. Cl.
*E21B 33/13* (2006.01)
*E21B 43/40* (2006.01)
*E21B 47/00* (2012.01)

(56) References Cited

U.S. PATENT DOCUMENTS 2,283,563 A * 5/1942 Lyons ..... E21B 29/02 166/376
3,489,211 A 1/1970 Kammerer, Jr.
4,071,278 A * 1/1978 Carpenter ..... E21B 43/2401 166/248
4,144,936 A 3/1979 Evans
4,652,054 A * 3/1987 Copenhafer ..... B01D 61/44 204/534
4,887,668 A * 12/1989 Lynde ..... B23B 5/16 166/55.8
2009/0014177 A1* 1/2009 Hilleary ..... E21B 33/14 166/285
2009/0184056 A1 7/2009 Smith et al.
2012/0061096 A1 3/2012 Jensen et al.
2013/0105159 A1 5/2013 Alvarez et al.
2013/0206425 A1* 8/2013 Mazyar ..... E21B 33/12 166/376
2013/0248185 A1* 9/2013 Parsche ..... E21B 36/04 166/302
2015/0247818 A1* 9/2015 Silvester ..... G01N 27/4045 205/793

FOREIGN PATENT DOCUMENTS

RU 2 396 416 C1 8/2010
WO WO 2014/060919 A2 4/2014

OTHER PUBLICATIONS

Combined Search And Examination Report for application No. GB1616383.4 dated Feb. 3, 2017.
Examination Report for Application No. GB 1416675.5 dated Jan. 30, 2017.
International Search Report for PCT/NO2015/050166 (PCT/ISA/210) dated Dec. 3, 2015.
International Search Report for PCT/NO2015/050165 (PCT/ISA/210) dated Dec. 3, 2015.
Search Report for Application No. GB 1515127.7 dated Mar. 17, 2016.
Written Opinion of the International Searching Authority for PCT/NO2015/050166 (PCT/ISA/237) dated Dec. 3, 2015.
Written Opinion of the International Searching Authority for PCT/NO2015/050165 (PCT/ISA/237) dated Dec. 3, 2015.

* cited by examiner

METHOD AND SYSTEM FOR REMOVING IRON-CONTAINING CASING FROM A WELL BORE

FIELD OF THE INVENTION

The present invention relates to methods of removing iron-containing (e.g. steel) casing from a well bore, e.g. as part of a plugging and abandonment procedure. The present invention also relates to systems for removing iron-containing (e.g. steel) casing from a well bore and a method of plugging and abandoning a well.

BACKGROUND

Wells used in gas and oil recovery need to be satisfactorily plugged and sealed after the wells have reached their end-of life and it is not economically feasible to keep the wells in service. Plugging of wells is performed in connection with permanent abandonment of wells due to decommissioning of fields or in connection with permanent abandonment of a section of a well to construct a new well bore (known as side tracking or slot recovery) with a new geological well target.

A well is constructed by a hole being drilled down into the reservoir using a drilling rig and then sections of steel pipe, referred to as liner or casing, are placed in the hole to provide mechanical, structural and hydraulic integrity to the well bore. Cement is placed between the outside of the liner and the bore hole and then tubing is inserted into the liner to connect the well bore to the surface.

Once the reservoir has been abandoned, a permanent well barrier must be established across the full cross-section of the well. This is generally achieved by removal of the inner tubing from the well bore by means of a workover rig which pulls the tubing to the surface. The liner, or at least portions of the liner, is also typically removed by a rig which essentially mills it out.

Well barriers, usually called plugs, are then established across the full cross-section of the well. Typically the plugs are formed with cement. This isolates the reservoir(s) and prevents flow of formation fluids between reservoirs or to the surface. It is often necessary to remove the inner tubing and liner from the wellbore in order to set the cement plug against the formation and thereby avoid any leaks. This is the case whenever there were problems in setting the cement in the first place and/or if there are doubts about the quality of the cement sheath.

Improperly abandoned wells are a serious liability so it is important to ensure that the well is properly plugged and sealed. However, the number of steps and equipment involved, such as a rig, results in this stage being costly and time-consuming, at a time when the well no longer generates revenue. Significantly the deployment of the rig in the abandonment operation means it cannot be utilised in the preparation of a new well or well bore.

SUMMARY OF INVENTION

Thus viewed from a first aspect the present invention provides a method of chemically removing iron-containing casing from a well bore comprising:

(i) injecting an acidic solution into said well bore, wherein said solution contacts said iron-containing casing and thereby accelerates oxidation of iron to iron cations;
(ii) allowing said iron cations to dissolve in said acidic solution; and
(iii) removing said solution from said well bore.

Viewed from a second aspect the present invention provides a system for removing iron-containing casing from a well bore comprising:

(i) a well bore comprising an iron-containing casing;
(ii) a first fluid line for injecting an acidic solution into said well bore;
(iii) a second fluid line for removing said acidic solution from said well bore;
(iv) a tank comprising said acidic solution; and
(v) a separation system for separating iron ions (e.g. iron compounds) and/or hydrogen from said acidic solution; wherein said tank is fluidly connected to said first fluid line;
said second fluid line is fluidly connected to said separation system; and
said separation system is fluidly connected to said tank.

Viewed from a third aspect the present invention provides a method of removing iron-containing casing from a well bore comprising:

(i) injecting an acidic solution into said well bore, wherein said acidic solution contacts said iron-containing casing and thereby accelerates oxidation of iron to iron cations; and
(ii) allowing said iron cations to dissolve in said acidic solution;

wherein said well bore is at least partially open to the atmosphere.

Viewed from a fourth aspect the present invention provides a method for monitoring the removal of an iron-containing casing from a well bore comprising:

(i) carrying out a chemical method for removing iron-containing casing from a well bore wherein $H_2$ gas is liberated in the process, e.g. a method as hereinbefore defined;
(ii) determining the amount of hydrogen liberated in the process; and
(iii) determining the amount of iron-containing casing dissolved.

Viewed from a fifth aspect the present invention provides a method of plugging and abandoning a well comprising;

(i) carrying out a method for removing iron-containing casing from a well bore as hereinbefore defined.

Definitions

As used herein the term "well bore" refers to a hole in the formation that forms the actual well. The well bore may have any orientation, e.g. vertical, horizontal or any angle in between vertical and horizontal. In the present case the well bore comprises a liner.

As used herein the term "casing" refers to any oil country tubular goods (OCTGs) including pipe, casing, liner and tubing. As described above a casing, e.g. a liner, is placed in the well bore after drilling to improve the structural integrity of the well. The well bore is located in the interior of the liner. Typically piping and tubing are located in the interior of the liner.

As used herein the terms "plugs" and "plugged" refer to barriers, or to the presence of barriers respectively, in a well bore. The purpose of plugs is to prevent the flow of formation fluids from the reservoir to the surface.

As used herein the term "interval" refers to a length of well bore.

As used herein the term "acidic solution" refers to a solution having a pH of less than 7.

As used herein the term "fluid" refers to a liquid or a gas.

As used herein the terms "remove", "removed" and "removal" refer to both active processes, i.e. ones in which the removal is brought about by e.g. an operator or equipment, and passive processes, i.e. ones in which the removal is an inevitable result of another process and does not involve intervention by e.g. an operator or equipment. A non-limiting example of active removal is bullheading. A non-limiting example of passive removal is displacement of a fluid resulting from an increase in pressure.

As used herein the term "displacement" refers to movement from one location to another location, e.g. from one interval of a well bore to a different interval of a well bore, or from a location within a well bore to a location outside of a well bore, such as the atmosphere or the formation. An example of displacement is the use of a first fluid to move a second fluid, the first fluid taking the place of the first fluid.

As used herein the term "electrochemical" refers to a chemical reaction, or group of chemical reactions, that require external electrical power or a voltage supply to occur. The electrical power or voltage supply forms part of a complete electrical circuit comprising the chemical reaction(s). In preferred electrochemical reactions employed in the present invention the liner is utilised as one electrode.

DESCRIPTION OF INVENTION

The first aspect of the present invention relates to a method of chemically removing iron-containing (e.g. steel) casing from a well bore. The method comprises:

(i) injecting an acidic solution into the well bore, wherein said acidic solution contacts the iron-containing casing and thereby accelerates oxidation of iron to iron cations;

(ii) allowing the iron cations to dissolve in the acidic solution; and (iii) removing the solution from the well bore.

In preferred methods of the first aspect invention, the casing is a liner. In further preferred methods of the invention, the iron-containing casing is steel. Preferred methods of the invention are continuous.

In preferred methods of the first aspect of the invention the iron-containing casing is removed from a selected interval of the well bore. Thus advantageously the methods of the invention are selective. This means that selected or targeted lengths of casing may be removed whilst other parts of the casing is left in place. This is beneficial because the well bore can be permanently plugged across the full cross section of the well bore in the interval from which the casing has been removed whilst minimising the cost of casing removal. A preferred selected interval is 0.5 to 200 m in length, more preferably 10 to 150 m in length and still more preferably 20 to 100 m in length. The selected interval is preferably located in the cap rock above a hydrocarbon depleted reservoir. Preferably the well bore and/or the selected interval is located offshore.

In some preferred methods of the first aspect of the invention the well bore is temporarily plugged above and temporarily or permanently below the selected interval of the well bore prior to the injection of acidic solution. Plugging may be carried out according to conventional procedures known in the art and using any conventional material which is acid resistant. The purpose of the plugs is to prevent the acidic solution from contacting areas of the casing which are to remain in the well bore. The plug above the interval allows for the transport of fluids into and from the interval of interest and is removable at the end of the method. The plug below the interval may be a permanent or temporary plug, such as a swell packer. Suitable plugs are commerically available. Preferred methods of the invention comprise a step of removing the temporary plugs.

In further preferred methods of the first aspect of the first aspect of the invention, the acidic solution is delivered into, and removed from, the well bore via a dual fluid line. Still more preferably the acidic solution is delivered into the well bore near the bottom of the selected interval of the well bore. Yet more preferably the acidic solution is removed from the well bore near the top of the selected interval of the well bore. Thus preferably the fluid line delivering acidic solution into the well bore is longer that the fluid line removing acidic solution from the well bore. Alternatively, however, the acidic solution may be delivered into the well bore near the top of the selected interval of the well bore and the acidic solution removed from the well bore near the bottom of the selected interval of the well bore.

The acidic solution may be injected into the well bore using conventional equipment and apparatus. Conventional coiled tubing may be used. Alternatively a dual fluid conduit such as that disclosed in U.S. Pat. No. 5,503,014 may be used.

Preferably the acidic solution has a linear velocity of 0.01 to 0.1 m/s in the well bore and still more preferably 0.05 to 0.2 m/s in the well bore. The provision of the acidic solution at relatively high velocities increases the rate of removal of the casing by mechanically breaking and fragmenting chemically weakened casing, as well as reducing the concentration of dissolved iron near the surface which may otherwise slow down the rate of its dissolution.

Preferably the acidic solution comprises a strong acid. Still more preferably the acidic solution comprises a strong acid selected from hydrochloric acid, sulfuric acid, nitric acid, hydrobromic acid, hydroiodic acid, perchloric acid and mixtures thereof. Hydrochloric acid and sulfuric acid are particularly preferred acids.

Particularly preferably the acidic solution comprises 5 to 50% wt acid, more preferably 10 to 40% wt acid and still more preferably 15 to 35% wt acid. Preferably the acidic solution has a pH of <5, more preferably <1 and still more preferably <0, for example a pH between −3 and 1.

The purpose of the acidic solution is to accelerate the oxidation of iron present in the casing. The iron present in the casing tends to oxidise to $Fe^{2+}$. The $Fe^{2+}$ ions react with $O_2$ or water to produce $Fe^{3+}$ or $Fe(OH)_2$ respectively. The electrons and the hydrogen ions react to produce hydrogen. The presence of the acidic solution accelerates the process by providing an excess of $H^+$ ions for the electrons to react with. Essentially the acidic solution accelerates a corrosion reaction.

The method of the first aspect of the invention therefore removes at least a portion of the iron-containing casing by ultimately causing it to dissolve into solution. This process significantly weakens the remaining casing, particularly as the acidic solution contacts the casing at relatively high velocity. Fragments or particles of the casing may therefore detach from the main body of the casing. Ideally these fragments or particles are removed from the well bore in the acidic solution.

Preferably the acidic solution further comprises a density modifying compound. Density modifying compounds include soluble salts and insoluble salts. Representative examples of suitable soluble salts include NaCl, KCl and $CaCl_2$. A representative example of a suitable solid is barite particles. Preferably the acidic solution solution comprises 0 to 30% wt density modifying compounds.

One particularly preferred acidic solution comprises HCl and NaCl. Another particularly preferred acidic solution consists essentially of (e.g. consists of) $H_2SO_4$.

Preferred methods of the first aspect of the invention further comprise reinjecting the acidic solution removed from the well bore into the well bore. This is advantageous as a typical casing will require treatment with relatively large volumes of acidic solution to be completely removed. Recycling or recirculating the acidic solution therefore enables significant cost savings to be made. In preferred methods of the invention 20 to 200 $m^3$ and more preferably 50 to 150 $m^3$ of acidic solution is in circulation.

Preferred methods of the first aspect of the invention further comprise removing the dissolved iron ions from the acidic solution prior to reinjecting the acidic solution into the well bore. Suitable methods for removing iron ions include precipitation and filtration and electrolysis. It is desirable to remove iron ions (e.g. iron compounds) from the acidic solution to avoid the acidic solution reaching the saturation limit for the ions.

Further preferred methods of the first aspect of the invention further comprise removing hydrogen from the acidic solution prior to reinjecting the acidic solution into the well bore. Conventional liquid/gas separation apparatus may be used. The hydrogen is collected, preferably monitored, and sent to flare.

In still further preferred methods of the first aspect of the invention iron ions (e.g. iron compounds) and hydrogen are removed from the acidic solution prior to reinjecting the acidic solution into the well bore. In this case the iron ions (e.g. iron compounds) may be removed either prior to, or after, the hydrogen. Thus preferred methods of the first aspect of the invention further comprise the steps of:

(i) removing the dissolved iron ions (e.g. iron compounds) from the acidic solution removed from the well bore;
(ii) removing hydrogen from the acidic solution removed from the well bore; and
(iii) reinjecting the acidic solution into the well bore.

The present invention also relates to a system for removing iron-containing casing from a well bore. The system comprises:

(i) a well bore comprising an iron-containing casing;
(ii) a first fluid line for injecting an acidic solution into the well bore;
(iii) a second fluid line for removing the acidic solution from the well bore;
(iv) a tank for the acidic solution; and
(v) a separation system for separating iron ions (e.g. iron compounds) and/or hydrogen from the acidic solution; wherein the tank is fluidly connected to the first fluid line;
the second fluid line is fluidly connected to the separation system; and
the separation system is fluidly connected to the tank.

Preferred systems of the invention comprise a well bore comprising temporary plugs above and temporary or permanent plugs below the interval from which the iron-containing casing is to be removed. In further preferred systems the first and second fluid lines are present in a dual fluid line. Preferably the first fluid line terminates near the bottom of the interval from which the iron-containing casing is to be removed and delivers acidic solution thereto. Preferably the second fluid line terminates near the top of the interval from which the iron-containing casing is to be removed and removes acidic solution therefrom.

In preferred systems of the invention the acidic solution is as hereinbefore defined.

Preferably the separation system comprises a means for monitoring the amount of hydrogen removed from the acidic solution. As described below in more detail, this advantageously enables the amount of iron-containing casing dissolved in the method of the invention to be monitored, e.g. determined.

Preferably the tank for acidic solution is located on a floating vessel. Preferably the separation system is located on a floating vessel. An advantage of the method and system of the present invention is that it does not require rig based equipment thereby leaving rigs free for other uses, e.g. drilling and preparing new wells.

In preferred methods of the first aspect of the invention the iron-containing casing is removed from a selected interval of the well bore. Thus advantageously the methods of the invention are selective. This means that selected or targeted lengths of casing may be removed whilst other parts of the casing is left in place. This is beneficial because the well bore can be permanently plugged across the full cross section of the well bore in the interval from which the casing has been removed, whilst minimising the cost of casing removal. A preferred selected interval is 0.5 to 200 m in length, more preferably 10 to 150 m in length and still more preferably 20 to 100 m in length. The selected interval is preferably located in the cap rock above a hydrocarbon depleted reservoir. Preferably the well bore and/or the selected interval is located offshore.

The present invention further provides a method for monitoring the removal of an iron-containing casing from a well bore comprising:

(i) carrying out a chemical method for removing iron-containing casing from a well bore according to the first aspect of the present invention wherein $H_2$ gas is liberated in the process;
(ii) determining the amount of hydrogen liberated in the process; and
(iii) determining the amount of iron-containing casing dissolved.

Approximately 18 kMol of hydrogen gas is generated per ton of casing, e.g. steel casing, dissolved. This is about 420 $m^3$ at atmospheric conditions. A 100 m section of 9⅝' casing comprises 8 tons of steel and therefore produces a total of about 3400 $m^3$ of hydrogen. Preferably the hydrogen is removed from the solution in a gas/liquid separator and then processed to flare at a safe location. The amount of hydrogen present in the solution returned from the well bore is preferably monitored and/or measured and used to determined how much steel has been dissolved and therefore how much steel still needs to be dissolved at any given point in time.

The present invention also provides a method of plugging and abandoning a well comprising;

(i) carrying out a method according to the first aspect of the present invention as hereinbefore defined; and
(ii) optionally sealing the well.

In preferred methods the well is a depleted hydrocarbon well.

The third aspect of the present invention relates to a method of removing iron-containing casing from a well bore comprising:

(i) injecting an acidic solution into said well bore, wherein said acidic solution contacts said iron-containing casing and thereby accelerates oxidation of iron to iron cations; and
(ii) allowing said iron cations to dissolve in said acidic solution;

wherein said well bore is at least partially open to the atmosphere.

In the method of the third aspect of the present invention, the well bore is at least partially open to the atmosphere. In other words the well bore is not pressurised by an external source (other than the atmosphere). Thus any gas produced by the method of the invention may not be entirely dissolved in the acidic solution, but may be present e.g. as bubbles within the acidic solution. Alternatively a gas may spontaneously separate from the acidic solution as or after the gas is produced.

In the method of the third aspect of the present invention, the acidic solution is injected into the well bore. The acidic solution may be injected into the whole well bore or into a part, e.g. an interval, of the well bore. In other words the acidic solution may be injected into less than the entire length of the well bore, i.e. less than 100% of the length of the well bore.

In preferred methods of the third aspect of the present invention the iron-containing casing is removed from a selected interval of the well bore. Thus advantageously the methods of the invention are selective. This means that selected or targeted lengths of casing may be removed whilst other parts of the casing is left in place. In such methods the acidic solution may be located in the desired interval of the well bore for the casing to be removed, optionally with other fluids above the interval and below the interval. This is beneficial because the well bore can be permanently plugged across the full cross section of the well bore in the interval from which the casing has been removed whilst minimising the cost of casing removal.

A preferred selected interval is 0.5 to 200 m in length, more preferably 10 to 150 m in length and still more preferably 20 to 100 m in length. The selected interval is preferably located in the cap rock above a hydrocarbon depleted reservoir. Preferably the well bore and/or the selected interval is located offshore.

In some methods of the third aspect of the present invention, a further solution is injected into the well bore after allowing said iron cations to dissolve in said acidic solution. This further solution may displace the acidic solution from the well bore, e.g. from the selected interval of the well bore. Alternatively the further solution and the acidic solution may mix together, e.g. by diffusion.

In some methods of the third aspect of the invention, the acidic solution is moved from the selected interval of the well bore to another interval within the well bore after allowing said iron cations to dissolve in said acidic solution. This movement may be by pumping, by displacement of the acidic solution and/or the further solution, or by any other conventional means.

Some methods of the third aspect of the invention further comprise the step of removing the acidic solution from said well bore. The removal may be an active or a passive process. A non-limiting example of an active removal is bullheading. A non-limiting example of passive removal is displacement of a fluid resulting from an increase in pressure.

In preferred methods of the third aspect of the invention, the casing is a liner. In further preferred methods of the invention, the iron-containing casing is steel. Preferred methods of the invention are batch methods, i.e. they are not continuous.

In preferred methods of the third aspect of the invention, a fluid is produced by contact of the acid solution with the iron-containing casing. Preferably the fluid is a gas.

In preferred methods of the third aspect of the invention, at least a portion of gas produced is removed from the well bore, e.g. by venting or by displacement out of the well bore. An example of such a displacement is bullheading of the gas into the formation (e.g. a hydrocarbon producing formation) in which the well bore is present. Alternatively or additionally, at least a portion of said gas may be removed by a downhole absorption or adsorption medium present in the well bore.

In preferred methods of the third aspect of the invention, the acidic solution is left in contact with said iron-containing casing for up to about 48 hours, preferably up to about 24 hours, more preferably up to about 12 hours, still more preferably for up to about 6 hours and yet more preferably for up to about 4 hours.

In preferred methods of the third aspect of the invention, a fluid, e.g. a gas, is produced by contact of the acid solution with the iron-containing casing. Preferably the fluid produced comprises hydrogen gas. In further preferred methods of the invention, the gas consists essentially of hydrogen gas. In yet further preferred methods of the invention, the gas consists of hydrogen gas, e.g. the gas is hydrogen gas.

In strong acids, iron dissolves anodically while $H_2$ evolution is the cathodic reaction occurring simultaneously at the steel surface. The total corrosion reaction is:

$$Fe+2H^+ \rightarrow Fe^{2+}+H_2\ (g)$$

Depending on the acidic solution used, the total reaction can be rewritten:

$$Fe+2HCl \rightarrow FeCl_2(aq)+H_2\ (g)$$

$$Fe+H_2SO_4 \rightarrow FeSO_4(aq)+H_2\ (g)$$

According to these reactions, a stoichiometric amount of $H_2(g)$ and dissolved $Fe^{2+}$ ions is produced for each mole of $H^+$ present in the acidic solution. In other words, one molecule of $H_2(g)$ is produced per iron atom oxidised. The amount of $H_2(g)$ produced can therefore be used to determine the amount of Fe dissolved. This advantageously enables the amount of iron-containing casing dissolved in the method of the invention to be monitored, e.g. determined.

Approximately 18 kMol of hydrogen gas is generated per ton of casing, e.g. steel casing, dissolved. This is about 440 $m^3$ at atmospheric conditions. A 100 m section of 9⅝' casing comprises 8 tons of steel and therefore produces a total of about 3400 $m^3$ of hydrogen. In some methods the hydrogen is removed from the solution in a gas/liquid separator and then processed to flare at a safe location. The amount of hydrogen present in the solution returned from the well bore may be monitored and/or measured and used to determined how much steel has been dissolved and therefore how much steel still needs to be dissolved at any given point in time.

In preferred methods of the third aspect of the invention, each of the aforementioned steps (i) and (ii) are sequentially repeated a plurality of times. In other words, in preferred methods the invention is a batch process, wherein an amount of acidic solution is injected into the well-bore, is left in contact with said iron-containing casing for the desired amount of time, is removed from the well bore, and a further additional amount of acidic solution is then injected into the well bore. This sequence may be repeated a plurality of times, e.g. at least two times, until the desired result is achieved (i.e. weakening of or dissolution of the iron-containing casing). In other words preferred methods of the invention are not continuous methods.

In other methods of the invention, the iron-containing casing is weakened prior to injecting the acidic solution into the well bore, e.g. by scraping, perforation or milling of the casing, or any combination thereof.

In some methods of the invention, the acidic solution is left in contact with the iron-containing casing for sufficient time for the iron-containing casing to be entirely dissolved.

This may result from one batch of a sufficient amount of acidic solution to entirely dissolve the casing, or from a plurality, e.g. more than one, of batches of acidic solution.

In other methods of the invention, the acidic solution is left in contact with the iron-containing casing for sufficient time for the iron-containing casing to be partially dissolved. In other words, the method comprises either one batch of acidic solution of insufficient concentration or volume to entirely dissolve the casing, or sufficient batches to partially dissolve the casing but not enough to entirely dissolve the casing.

In some preferred methods, the method further comprises the step of removing the iron-containing casing by milling. In such methods the initial treatment of the casing with the acidic solution reduces the amount of time that the milling step requires to remove the iron-containing casing, compared to a similar process in which there was no treatment of the casing with an acidic solution. Thus advantageously milling of the casing may be conducted more quickly, which has economic and operational benefits.

In other preferred methods of the third aspect of the present invention, the acidic solution is left in contact with the iron-containing casing for sufficient time for the iron-containing casing to be substantially completely dissolved, e.g. completely dissolved.

In some methods of the third aspect of the invention the well bore is temporarily plugged above and temporarily or permanently below the selected interval of the well bore prior to the injection of acidic solution. Where a plug is used, it may be present above the selected interval or below the selected interval. Plugging may be carried out according to conventional procedures known in the art and using any conventional material which is acid resistant. Alternatively, in other methods of the third aspect of the invention no plugs are used. In such methods, a pill of a viscous or dense fluid may be used to prevent mixing with fluids (e.g. formation fluids) above and/or below the acidic solution in the well bore. In other words the location of the acidic solution in the well bore is controlled using other liquids rather than physical barriers, e.g. a plug. A combination of plugs and one or more viscous pills is also possible. The purpose of the plugs and/or viscous pills is to prevent the acidic solution from contacting areas of the casing which are to remain in the well bore. The plug above the interval, where present, allows for the transport of fluids into and from the interval of interest and is removable at the end of the method. The plug below the interval, where present, may be a permanent or temporary plug, such as a swell packer. Suitable plugs are commercially available. Preferred methods of the third aspect of the invention comprise a step of removing the temporary plugs, where present.

As with the first aspect of the present invention, the acidic solution may be injected into the well bore using conventional equipment and apparatus. Conventional coiled tubing may be used. A conventional drillstring may also be used for injecting the acidic solution. In this case the relatively small internal volume of the drillstring will reduce the time taken to inject a further batch of acidic solution. Alternatively a dual fluid conduit such as that disclosed in U.S. Pat. No. 5,503,014 may be used, particularly in cases where the risks associated with pumping the acidic solution directly into the well bore are considered to be too high. In preferred methods of the third aspect of the invention, the acidic solution is placed into the selected interval of the well bore, through the existing well bore, i.e. the tubing or casing. That is, in preferred methods of the third aspect of the invention no additional hardware is required to inject the acidic solution into well bore.

The acid solution comprises an organic acid or an inorganic acid. Preferably the acidic solution comprises a strong acid.

Preferred organic acids are selected from $C_1$-$C_{10}$ alkyl carboxylic acids or derivatives thereof such as formic acid, acetic acid, propionic acid, butyric acid, valeric acid, caproic acid, oxalic acid, lactic acid, malic acid and citric acid, including halogenated $C_1$-$C_{10}$ alkyl carboxylic acids such as trifluoroacetic acid and trichloroacetic acid; substituted or unsubstituted aryl carboxylic acids such as benzoic acid, p-toluenesulfonic acid, trifluoromethanesulfonic acid and phenol; and mixtures thereof.

Preferred inorganic acids are selected from hydrochloric acid, sulfuric acid, nitric acid, hydrobromic acid, hydroiodic acid, perchloric acid, phosphoric acid, phosphonic acid and mixtures thereof.

Hydrochloric acid, phosphonic acid and sulfuric acid are particularly preferred acids.

Particularly preferably the acidic solution comprises 5 to 50% wt acid, more preferably 10 to 40% wt acid and still more preferably 15 to 35% wt acid. Preferably the acidic solution has a pH of <5, more preferably <1 and still more preferably <0, for example a pH between −3 and 1.

The purpose of the acidic solution is to accelerate the oxidation of iron present in the casing. The iron present in the casing tends to oxidise $Fe^0$ to $Fe^{2+}$. The presence of the acidic solution accelerates the process by providing an excess of $H^+$ ions for the electrons to react with. Essentially the acidic solution accelerates a corrosion reaction. Where the acidic solution comprises HCl, $FeCl_2$ is produced as a reaction product of the oxidation of the iron present in the casing.

The method of the third aspect of the invention therefore removes at least a portion of the iron-containing casing by ultimately causing it to dissolve into solution. This process significantly weakens the remaining casing, particularly as the acidic solution contacts the casing at a high rate of convection due to the formation of gas and this gas circulating in the acid solution, e.g. migrating upwards in the well bore (for a vertical well). Fragments or particles of the casing may also detach from the main body of the casing. Ideally these fragments or particles are removed from the well bore in the acidic solution.

The acidic solution may further comprise a density modifying compound. Density modifying compounds include soluble salts and insoluble materials. Representative examples of suitable soluble salts include NaCl, KCl and $CaCl_2$. A representative example of a suitable material is barite particles. Preferably the acidic solution comprises 0 to 30% wt density modifying compounds.

One particularly preferred acidic solution comprises HCl and NaCl. Another particularly preferred acidic solution consists essentially of (e.g. consists of) $H_2SO_4$. Another particularly preferred acidic solution consists essentially of (e.g. consists of) $H_3PO_3$.

In preferred methods of the third aspect of the invention 1 to 20 $m^3$ and more preferably 2 to 6 $m^3$ of acidic solution is used per batch, where a batch is used to treat a selected interval of about 100 m of 9⅝" casing.

In some methods of the third aspect of the invention, the dissolved iron ions are removed from the acidic solution prior to reinjecting the acidic solution into the well bore. Suitable methods for removing iron ions include precipitation and filtration and electrolysis. It is desirable to remove iron ions (e.g. iron compounds) from the acidic solution to avoid the acidic solution reaching the saturation limit for the ions.

While hydrogen is being generated downhole, this will cause the entire liquid column in the well to expand as the gas produced migrates upwards. This will lead to liquid overflow from the well. This liquid overflow may be handled by an expansion drum in order to prevent acid from entering the flare system together with the gas produced. Such an expansion drum will provide proper separation of well fluid/mud and gas. The expansion drum must be supplied specifically—for this method to be implemented at the top of the well, between the wellhead and the flare system. For separation of the gas from produced fluids, conventional liquid/gas separation apparatus may be used. Where the gas produced is hydrogen, it is collected, preferably monitored, and sent to flare.

In alternative methods of the third aspect of the invention iron ions (e.g. iron compounds) and hydrogen are removed from the acidic solution prior to reinjecting the acidic solution into the well bore. In this case the iron ions (e.g. iron compounds) may be removed either prior to, or after, the hydrogen. Thus preferred methods of the third aspect of invention further comprise the steps of:

(iii) removing the dissolved iron ions (e.g. iron compounds) from the acidic solution removed from the well bore;

(iv) removing hydrogen from the acidic solution removed from the well bore; and (v) reinjecting the acidic solution into the well bore.

The third aspect of the present invention also provides an alternative method of removing iron-containing (e.g. steel) casing from a well bore, further comprising the steps:

(i) providing a cathode in said well bore, wherein the cathode is connected to the negative pole of a power source;

(ii) connecting the iron-containing casing to the positive pole of the power source;

(iii) injecting an electrolyte into the well bore, wherein the electrolyte contacts the iron-containing casing and the cathode;

(iv) applying a current so that the iron in the iron-containing casing is oxidised to iron cations;

(v) allowing the iron cations to dissolve in the electrolyte; and (vi) removing the electrolyte from the well bore.

These additional electrochemical steps may be employed to further accelerate the oxidation of iron in the iron-containing casing to iron cations.

In preferred methods of this aspect of the invention the iron-containing casing is removed from a selected interval of the well bore. Thus advantageously the methods of the invention are selective. This means that selected or targeted lengths of casing may be removed whilst other parts of the casing is left in place. This may be achieved by pumping a neutralising fluid behind the acid so that the volume of the well behind the acid is protected. This is beneficial because the well bore can be permanently plugged across the full cross section of the well bore in the interval from which the casing has been removed, whilst minimising the cost of casing removal. A preferred selected interval is 0.5 to 200 m in length, more preferably 10 to 150 m in length and still more preferably 20 to 100 m in length. The selected interval is preferably located in the cap rock above a hydrocarbon depleted reservoir. Preferably the well bore and/or the selected interval is located offshore.

In some methods of this preferred method of the third aspect of the invention the exterior surface of a fluid line for injecting electrolyte into the well bore forms the cathode. Preferably the exterior surface of the fluid line is metallic. Representative examples of suitable metals include iron, e.g. steel. Preferably the cathode, and still more preferably the fluid line having an exterior surface forming the cathode, is centrally located in the well bore.

In some options of this preferred method of the third aspect of the invention the well bore is temporarily plugged above and temporarily or permanently plugged below the selected interval of the well bore prior to the injection of electrolyte. Temporary and permanent plugging may be carried out according to conventional procedures known in the art and using any conventional material which is resistant to electrolyte. The purpose of the plugs is to prevent the electrolyte from contacting areas of the casing which are to remain in the well bore.

In other options of this preferred method of the third aspect of the invention the well bore is not temporarily or permanently plugged. In such methods the treatment of a selected interval of the well bore is preferably achieved by the location of the cathode. More preferably the exterior surface of a fluid line is partially electrically conducting (i.e. cathodic) and partially insulated. In other words the exterior surface of a fluid line is patterned so that it functions as a cathode in certain areas and as an insulator in other areas. In such methods the fluid line is preferably made of a metallic material but is partially coated with a non-metallic material, i.e. in those areas where it is to be insulating.

In other preferred options of this preferred method of the third aspect of the invention, particularly when a fluid line having an exterior surface which is partially electrically conducting and partially insulating is used, the electrolyte is delivered into the well bore via a first fluid line. Preferably the electrolyte is delivered into the well bore near the bottom of the selected interval of the well bore. In this method, the electrolyte is preferably removed from the well bore via the well bore. This is feasible because the electrolyte will not cause any significant damage to the casing in the absence of electrical current, i.e. it only induces significant oxidation in those areas where a cathode is provided.

In methods of the third aspect of the invention that involve the additional electrochemical steps mentioned above, the electrolyte may be injected into the well bore using conventional equipment and apparatus. Preferably the electrolyte has a superficial linear velocity of 1 to 50 cm/s in the well bore and more preferably 5 to 25 cm/s in the well bore. The provision of the electrolyte at relatively high velocities increases the rate of removal of the casing by mechanically breaking and fragmenting chemically weakened casing as well as reducing the concentration of dissolved iron near the surface which may otherwise slow down the rate of its dissolution.

In such methods the electrolyte may be any fluid that is electrically conducting. Preferably the electrolyte comprises at least 2 wt % salt and more preferably at least 3% wt salt. The maximum level of salt in the electrolyte may be 30% wt. Typical salts present in the electrolyte include NaCl, KCl and $CaCl_2$. NaCl is particularly preferred. An example of a suitable electrolyte is sea water.

In methods of the third aspect of the invention that involve the additional electrochemical steps mentioned above preferred electrolytes for use in the methods of the present invention further comprises an iron cation stabilising compound. Suitable compounds include strong acids, for example, hydrochloric acid, sulfuric acid, nitric acid, hydrobromic acid, hydroiodic acid, perchloric acid and mixtures thereof. Hydrochloric acid and sulfuric acid are particularly preferred acids. The electrolyte preferably comprises 2 to 30% acid, more preferably 5 to 25 wt % acid and still more preferably 10 to 25% wt acid. Preferably the electrolyte has a pH of <5, more preferably <1 and still more preferably <0, for example a pH between −3 and 1.

One particularly preferred electrolyte comprises HCl and NaCl. Another particularly preferred electrolyte consists essentially of (e.g. consists of) $H_2SO_4$ (sulfuric acid). Yet another particularly preferred electrolyte consists essentially of (e.g. consists of) $H_3PO_3$ (phosphonic acid).

The purpose of the electrolyte is to complete the electrical circuit that facilitates the dissolution of iron present in the iron-containing casing by electrolysis. The application of current causes oxidation of the iron to $Fe^{2+}$ in the casing. The electrons react with $H^+$, either from water or from acid present in the electrolyte, at the cathode to produce hydrogen gas.

In preferred methods of the third aspect of the invention that involve the additional electrochemical steps mentioned above the electrical current density applied is 50 to 2000 ampere/$m^2$ casing surface, more preferably 75 to 1500 ampere/$m^2$ casing surface and still more preferably 100 to 1000 ampere/$m^2$ casing surface. Preferably the voltage is in the range 1 to 10 V and more preferably 2 to 5 V. Preferably the power supplied is 5 to 500 kW and more preferably 10 to 400 kW, for removal of a 100 m section of casing.

In these preferred methods, at least a portion of the iron-containing casing is removed by ultimately causing it to dissolve into solution. This process significantly weakens the remaining casing, particularly as electrolyte contacts the casing at relatively high velocity. Fragments or particles of casing may therefore detach from the main body of the casing. Ideally these fragments or particles are removed from the well bore in the electrolyte.

Preferably therefore the electrolyte further comprises a density modifying compound. Density modifying compounds include soluble salts and insoluble salts. Representative examples of suitable soluble salts include NaCl, KCl and $CaCl_2$. Representative examples of suitable solids include barite (e.g. barium sulphate) particles. Preferably the electrolyte comprises 0 to 30% wt density modifying compounds.

Preferred methods of the third aspect of the invention that involve the additional electrochemical steps mentioned above further comprise reinjecting the electrolyte removed from the well bore into the well bore. This is advantageous as a typical casing will require treatment with relatively large volumes of electrolyte to be completely removed. Recycling or recirculating the electrolyte therefore enables significant cost savings to be made. In preferred methods of the invention 20 to 200 $m^3$ and more preferably 50 to 150 $m^3$ of electrolyte is in circulation.

Preferred methods of the third aspect of the invention that involve the additional electrochemical steps mentioned above further comprise removing the dissolved iron ions, e.g. iron compounds, from the electrolyte prior to reinjecting the electrolyte into the well bore. Suitable methods for removing iron ions (e.g. iron compounds) include precipitation and filtration and electrolysis. It is desirable to remove iron ions (e.g. iron compounds) from the electrolyte to avoid the electrolyte reaching the saturation limit for the ions.

Further preferred methods of the third aspect of the invention that involve the additional electrochemical steps mentioned above further comprise removing hydrogen from the electrolyte prior to reinjecting the electrolyte into the well bore. Conventional liquid/gas separation apparatus may be used. The hydrogen is collected, preferably monitored and measured, and sent to flare.

In still further preferred methods of the third aspect of the invention that involve the additional electrochemical steps mentioned above, iron ions (e.g. iron compounds) and hydrogen are removed from the electrolyte prior to reinjecting the electrolyte into the well bore. In this case the iron ions (e.g. iron compounds) may be removed either prior to, or after, the hydrogen. Thus preferred methods of this aspect of the invention further comprise the steps of:

(vi) removing the dissolved iron ions (e.g. iron compounds) from the electrolyte removed from the well bore;

(vii) removing hydrogen from the electrolyte removed from the well bore; and (viii) reinjecting the electrolyte into the well bore.

The present invention also provides a method of plugging and abandoning a well comprising;

(iii) carrying out a method according to the third aspect of the present invention as hereinbefore defined; and (iv) optionally sealing the well.

In preferred methods the well is a depleted hydrocarbon well.

DETAILED DESCRIPTION OF INVENTION

Figure 1:
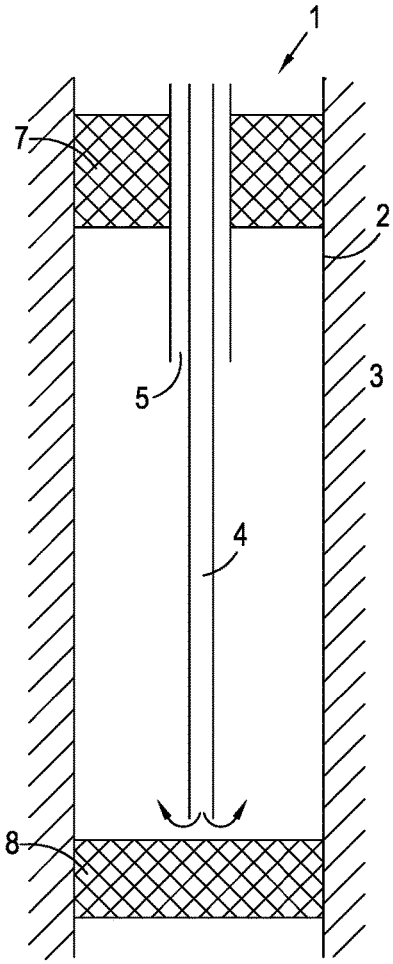
FIG. 1 is a schematic of a part of a system for carrying out a preferred chemical method of a first aspect of the invention for removing iron-containing casing from a well.

FIG. 1 shows a system and method for removing iron-containing casing (e.g. steel) 2 from a well 1 in accordance with a first aspect of the present invention. Generally the casing 2 is fixed in the formation by cement 3. The interior of the casing 2 forms the well bore. The well bore shown in FIG. 1 is vertical, but the well could be any orientation. Formerly the well was used in the production of hydrocarbon.

A first fluid line 4 and a second fluid line 5 are provided in the form of a dual fluid line. The first fluid line 4 is connected to a tank 6 on the surface (not shown). First fluid line 4 extends into the well and terminates near the bottom of the interval from which iron-containing, e.g. steel, casing is to be removed. A second fluid line 5, extends into the well and terminates near the top of the interval from which iron-containing, e.g. steel, casing is to be removed.

The well further comprises temporary plugs 7, 8 which are located at the top and bottom of the interval from which the iron-containing, e.g. steel, casing is to be removed. The plugs prevent the solution introduced via the first fluid line 4 from contacting any other parts of the casing or well bore which are located outside the interval where the casing is to be removed. In other words the plugs enable iron-containing casing to be selectively removed from an interval of the well, namely the interval in between the plugs. Generally this interval will be 20-100 m in length. The conditions in the well in this interval are typically a temperature of 50 to 150° C. and a pressure of 250 to 500 bar.

In a preferred method of this first aspect of the invention, an acidic solution, typically HCl or $H_2SO_4$ (10-40% wt) is injected into the well bore from tank 6 via the first fluid line 4. It contacts the iron-containing casing 2 and accelerates the oxidation of iron to $Fe^{2+}$. The $Fe^{2+}$ cations, in turn, dissolve in the acidic solution. The electrons react with $H^+$ to produce hydrogen. The acidic solution comprising the iron cations is removed from the well bore via the second fluid line 5 and is treated, as described below, before being reinjected back into the well bore via first fluid line 4. Fragments of casing which break off during the method may also be returned to the surface in suspension in the acidic solution, i.e. not all of the casing must dissolve.

The acidic solution is preferably continuously recirculated through the first and second fluid lines until the iron-containing (e.g. steel) casing is completely removed. Preferably the acidic solution has a linear velocity of 0.05 to 0.2 m/s in the iron-containing casing. Preferably the volume of acidic solution circulating is 20 to 200 $m^3$ The time taken to remove casing is typically about 10 days per 100 m of casing.

Figure 2:
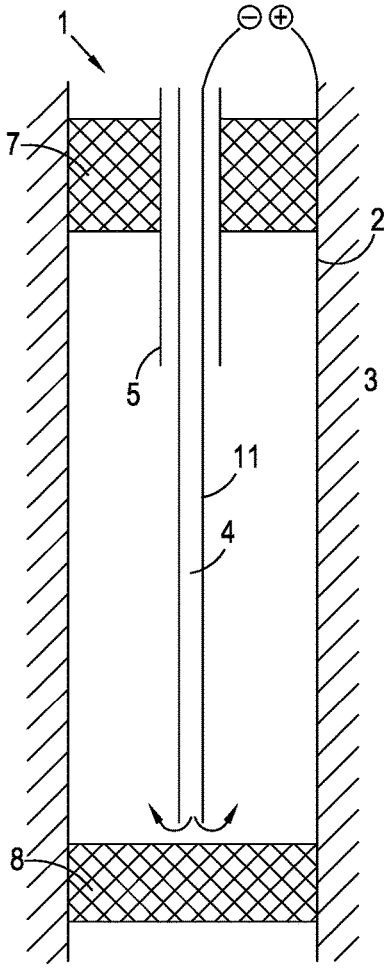
FIG. 2 is a schematic of a part of a system for carrying out a preferred electrochemical method of the invention for removing iron-containing casing from a well.

FIG. 2 shows an alternative system and method for removing an iron-containing (e.g. steel) casing 2 from a well 1 according to the first aspect of the present invention which further comprises an electrochemical step after the acidic removal step. The casing 2 is fixed in the formation by cement 3 and the interior of the casing 2 forms the well bore. As in FIG. 1 the system comprises a first fluid line 4 and a second fluid line 5 in the form of a dual fluid line. The first fluid line 4 is connected to a tank 6 on the surface (not shown). The well bore also comprises temporary plugs 7, 8 which are located at the top and bottom of the interval from which the iron-containing casing, e.g. steel is to be removed. These features are all identical to those described above with reference to FIG. 1.

In FIG. 2, the iron-containing casing 2, which is electrically conductive, is connected to the positive pole of a power source 10. The negative pole of the power source 10 is connected to the exterior surface of first fluid line 4 which is electrically conducting. This forms the cathode 11. Advantageously the first fluid line 4 and therefore the cathode is 11 is located centrally within the well bore.

In a preferred method of the invention, an electrolyte, typically sea water is injected into the well bore from a tank 6 (not shown) via the first fluid line 4. Preferably the electrolyte has a superficial linear velocity of 2 to 50 cm/s in the well bore. Power is applied via power source 10. Preferably the electrical current density is 100 to 1000 ampere/$m^2$ casing surface and the voltage is 2 to 5 v. For a 100 m interval the total electrical power supply is therefore 7000-70,000 ampere which corresponds to a power requirement of about 14 to 350 kW.

The current causes oxidation of the anode, i.e. the iron-containing casing 2 and reduction of the cathode, i.e. the exterior surface of the first fluid line 4. The $Fe^{2+}$ cations formed by oxidation of the casing dissolve in the electrolyte. The hydrogen formed by reduction is also present in the electrolyte. The electrolyte is preferably removed via the second fluid line 5. Preferably the electrolyte is continuously recirculated through the first and second fluid lines until the iron-containing (e.g. steel) casing is completely removed. The time taken to remove casing is typically about 5-6 days per 100 m of casing. Preferably the volume of electrolyte circulating in the system is 50 to 150 $m^3$.

Figure 3:
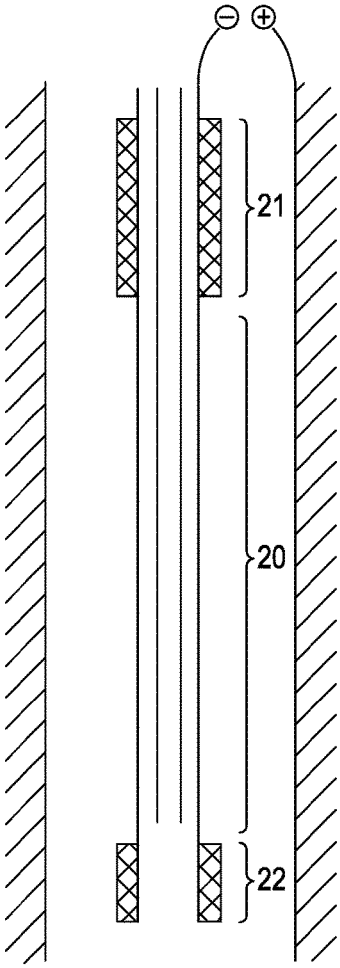
FIG. 3 is a schematic of a part of a system for carrying out an alternative preferred electrochemical method of the invention for removing iron-containing casing from a well.

FIG. 3 shows an alternative system and method according to the first aspect of the present invention which further comprises an electrochemical step after the acidic removal step for removing an iron-containing (e.g. steel) casing 2 from a well 1. As in FIG. 2 the casing 2 is fixed in the formation by cement 3 and the interior of the casing 2 forms the well bore. Additionally, as in FIG. 2, the casing 2, which is electrically conducting, is connected to the positive pole of a power source 10.

Also as in FIGS. 1 and 2, the system comprises a first fluid line 4 connected to a tank 6 on the surface (not shown). An electrolyte, typically sea water, is injected into the well bore via the first fluid line 4.

In FIG. 3 the cathode which is connected to the negative pole of the power source, is formed by the exterior surface of the first fluid line 4. In this embodiment the exterior surface of the first fluid line 4 is partially electrically conducting and partially insulating. Thus in the interval 20 where iron-containing, e.g. steel, casing is to be removed, the exterior surface of the first fluid line is electrically conducting whereas in the areas 21, 22 where the iron-containing casing is to remain the exterior surface of the first fluid line 4 is non-electrically conducting, e.g. coated with an insulating material. Advantageously this means that neither plugs nor a dual coil fluid line is required. Instead the electrolyte can be pumped out of the well bore via the well bore.

FIGS. 1-3 illustrate how the systems and methods of the first aspect of the present invention allow for selective chemical, and optionally further electrochemical removal of iron-containing casing from a well bore. The same can be achieved with the selective chemical, and optional further electrochemical removal of iron-containing casing from a well bore according to the third aspect of the present invention. In the embodiments shown in FIGS. 1 and 2 selectivity is achieved by using plugs. In this case the iron is removed in the interval in between the plugs. In the embodiment shown in FIG. 3 selectivity is achieved by the placement of the cathode, e.g. by making the exterior surface of the fluid line partially electrically conducting (i.e. cathodic) and partially insulating. In this case iron is removed in the interval where the exterior surface of the first fluid line is electrically conducting, i.e. cathodic.

The methods and systems described above in relation to FIGS. 2 and 3 can also be suitably adjusted to provide a further electrochemical step after the acidic treatment step in the third aspect of the invention as described and exemplified below.

In the methods and systems of the first aspect of the present invention the acidic solution is preferably removed from the well bore and ultimately reinjected therein. Preferably the solution is treated to remove iron ions (e.g. iron compounds) and/or hydrogen prior to reinjection into the well bore as shown in FIG. 4.

Figure 4:
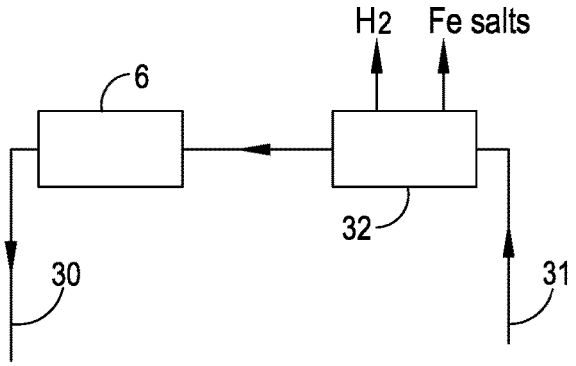
FIG. 4 is a flow diagram of a preferred system of the present invention.

FIG. 4 shows a system and method for recirculating the solution. Arrow 30 shows the solution, i.e. acidic solution or electrolyte, being pumped into the well bore (not shown) in a first fluid line 4. In the well bore the solution accelerates the oxidation of iron to iron cations. This reaction produces iron ions which dissolve and hydrogen as described above. Arrow 31 shows the solution being pumped out of the wellbore via fluid line 5 or via the well bore itself. This solution is fed into a separation unit 32 which comprises a gas/liquid separator to faciliate removal of hydrogen gas. The hydrogen gas is collected, and preferably measured, and sent for flare. The separation unit 32 also comprises a means to remove iron ions from the solution. After removal of $H_2$ and iron ions the solution is fed to a tank 6 from where it is injected back into the well bore.

Figure 12:
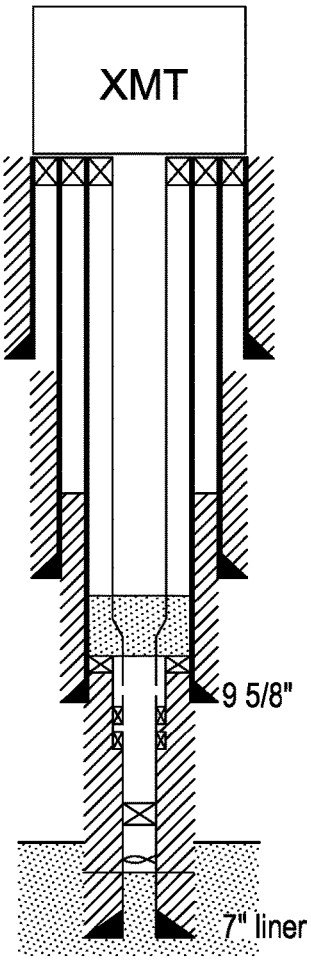
FIG. 12 is a schematic of a part of a system for carrying out a preferred method of the third aspect of the present invention for removing iron-containing casing from a well.

FIG. 12 shows a system and method according to the third aspect of the present invention for removing iron-containing casing (e.g. steel) from a well. Generally the casing is fixed in the formation by cement. The interior of the casing forms the well bore. The well bore shown in FIG. 12 is vertical, but the well could be any orientation. Formerly the well was used in the production of hydrocarbon.

Formation water (e.g. sea water) is first displaced from the well by bullheading. A pill of an acidic solution, typically HCl, $H_3PO_3$ or $H_2SO_4$ (10-40% wt) is injected into the well bore. The pill typically occupies around 100-150 m of the length of the iron-containing casing to be treated. It contacts the iron-containing casing and accelerates the oxidation of iron to $Fe^{2+}$. The $Fe^{2+}$ cations, in turn, dissolve in the acidic solution. The electrons react with $H^+$ to produce hydrogen.

The acidic solution is left in contact with the casing for sufficient time for the casing to be corroded to the desired extent, e.g. up to about 24 hours, preferably up to about 12 hours, more preferably up to about 6 hours, still more preferably up to about 4 hours.

During this time the acidic solution corrodes the casing, resulting in the production of hydrogen gas and heat, as well as iron cations and/or iron-containing salts. The well bore is at least partially capable of venting at least some, preferably all, of the hydrogen gas generated by the corrosion of the casing. The hydrogen gas may, for example, be vented through a drillstring. Preferably, hydrogen is vented straight up the wellbore without any dedicated conduit. The generation of hydrogen gas in the area of the casing that is in contact with the corrosive solution creates convection currents in the solution. The convection currents cause the solution in the region of the surface of the casing, i.e. the solution into which the iron from the casing is dissolved, to be displaced from the surface. The motion of the fluid resulting from the convection currents may further accelerate the corrosion of the casing, both by providing fresh fluid (i.e. fluid that contains a lower concentration of iron cations and/or iron-containing salts) to the surface and by the physical action of the fluid on the surface of the casing.

The acidic solution may be left in contact with the casing for sufficient time for the entire casing to be dissolved. Replacement of the acid may be required for removing the entire pipe. One batch will typically corrode away up to about 1 mm of casing thickness before it is saturated with iron cations. 10-40 batches will be required to dissolve the entire casing wall. Alternatively, the acidic solution may be left in contact with the casing only for sufficient time for the casing to be partially dissolved or partially corroded, e.g. etched, perforated or otherwise weakened. In such cases the casing may be removed by milling after removal of the acidic solution. The action of the acidic solution facilitates milling by weakening the casing, such that the subsequent milling can be done more easily or more quickly.

The acidic solution comprising the iron cations is removed from the well bore, e.g. via a second fluid line or by the well bore itself and is optionally treated, as described below, and may thereafter be reinjected back into the well bore. Fragments of casing which break off during the method may also be returned to the surface in suspension in the acidic solution, i.e. not all of the casing must dissolve. Alternatively the acidic solution may be bullheaded into the formation, e.g. by sea water or a further drilling or treatment fluid.

After the first pill of acidic solution is removed, a further pill of acidic solution may be injected into the formation as described above. The further pill is left in contact with the casing for the desired length of time, again as detailed above, before removal, e.g. by bullheading. Further additional pills may be added in this manner until the casing has been corroded to the desired extend, e.g. partial corrosion or complete corrosion and/or dissolution of the casing. The method of the third aspect of the present invention is therefore a batch process, wherein one or more batches of acidic solution are placed in contact with the casing in a sequential manner.

The well may further comprise temporary plugs which are located at the top and bottom of the interval from which the iron-containing, e.g. steel, casing is to be removed. The plugs prevent the solution from contacting any other parts of the casing or well bore that are located outside the interval where the casing is to be removed. In other words the plugs enable iron-containing casing to be selectively removed from an interval of the well, namely the interval in between the plugs. Generally this interval will be 20-200 m in length. The conditions in the well in this interval are typically a temperature of 50 to 150° C. and a pressure of 250 to 500 bar, but this may vary depending on the particular well bore in which the method is employed.

Figure 13:
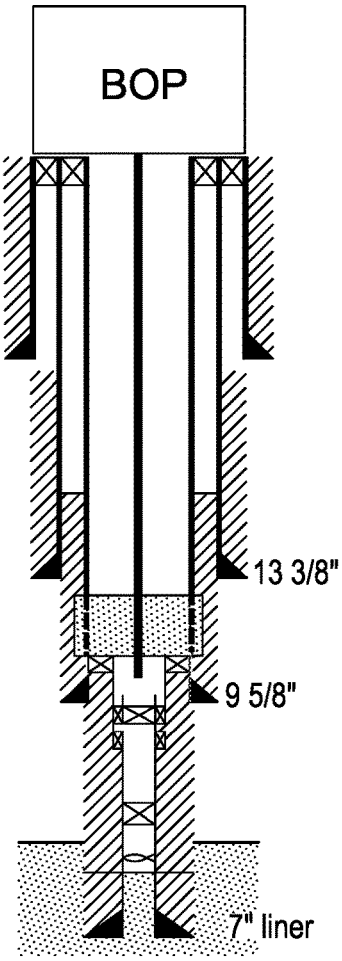
FIG. 13 is a schematic of a part of a system for carrying out an alternative preferred method of the third aspect of the present invention for removing iron-containing casing from a well.

FIG. 13 shows an alternative system and method according to the third aspect of the present invention for removing an iron-containing (e.g. steel) casing from a well. In this method the casing is first perforated, e.g. by milling, before the pill of acidic solution is placed into the well bore. This ensures that corrosion takes place from both the interior and exterior surfaces of the casing. Optionally, a drill string may be lowered to below the level of the pill of acidic solution and thereafter is used to remove used and/or saturated solution from the well bore. As described above, this method is also a batch process, wherein one or more batches of acidic solution are placed in contact with the casing in a sequential manner.

Figure 14:
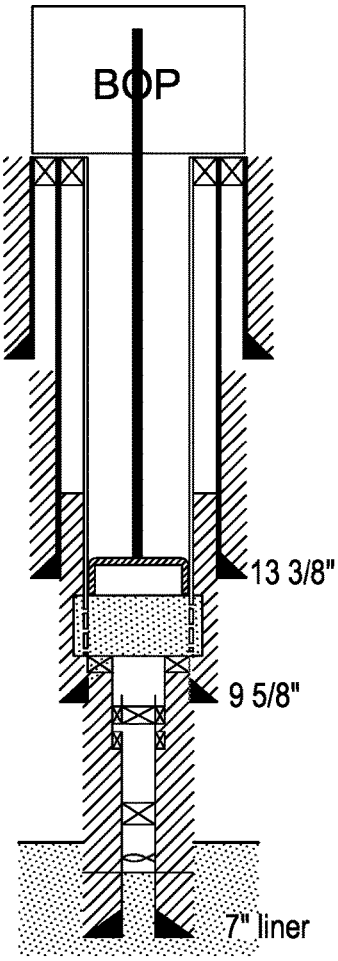
FIG. 14 is a schematic of a part of a system for carrying out an alternative preferred method of the third aspect of the present invention for removing iron-containing casing from a well.

FIG. 14 shows an alternative system and method according to the third aspect of the present invention for removing an iron-containing (e.g. steel) casing from a well. In this method the casing may first be perforated, e.g. by milling, before the pill of acidic solution is placed into the well bore by a drill pipe. The drill pipe may comprise a retrievable swab cup or annular packer. In this method the drill pipe allows the venting of the hydrogen produced by the corrosion of the iron-containing casing by the acidic solution. The drill pipe may also be used to place a second (or further) pill of the corrosive solution in a batch-wise manner, as described above in relation to the methods shown in FIG. 12 and FIG. 13.

Figure 15:
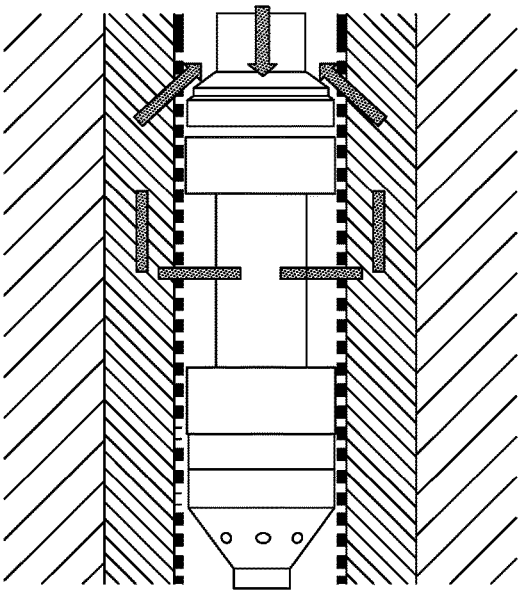
FIG. 15 is a schematic of a part of a system for carrying out an alternative preferred method of the third aspect of the present invention for removing iron-containing casing from a well.

FIG. 15 shows a related system that may be used in conjunction with any of the aforementioned systems according to the third aspect of the present invention, or alone. In this method, a swab cup assembly is used to wash the perforations of a perforated casing, to clean the iron-containing (e.g. steel) surfaces of the casing. The acidic solution is subsequently placed at the location of the casing to be corroded and/or dissolved via the swab cup assembly. This ensures good contact of the acidic solution with the inner and outer surfaces of the casing. The arrows show the direction of flow of the acidic solution from the swab cup assembly.

In a preferred system and method according to the third aspect of the invention, an electrolyte, typically sea water is injected into the well bore. The electrolyte may be injected before, after, or simultaneously with the acidic solution. Preferably the electrolyte has a superficial linear velocity of 2 to 50 cm/s in the well bore. Power is applied via a power source. Preferably the electrical current density is 100 to 1000 ampere/$m^2$ casing surface and the voltage is 2 to 5 V. For a 100 m interval the total electrical power supply is therefore 7000-70,000 ampere which corresponds to a power requirement of about 14 to 350 kW.

The current causes oxidation of the anode, i.e. the iron-containing casing and reduction of the cathode, i.e. the exterior surface of the first fluid line. The $Fe^{2+}$ cations formed by oxidation of the casing dissolve in the electrolyte. The hydrogen formed by reduction is also present in the electrolyte. Preferably the electrolyte is continuously recirculated through the first and second fluid lines until the iron-containing (e.g. steel) casing is completely removed. The time taken to remove casing is typically about 5-6 days per 100 m of casing. Preferably the volume of electrolyte circulating in the system is 50 to 150 $m^3$.

In the methods and systems of the third aspect of the present invention the solution (acidic solution or electrolyte) is preferably removed from the well bore and may optionally be reinjected therein. Preferably the solution is treated to remove iron ions (e.g. iron compounds) and/or hydrogen prior to reinjection into the well bore as shown in FIG. 15.

FIG. 4 previously discussed shows a system and method suitable for a method according to the third aspect of the present invention for recirculating the solution. Arrow 30 shows the solution, i.e. acidic solution or electrolyte, being pumped into the well bore (not shown) in a first fluid line 4. In the well bore the solution accelerates the oxidation of iron to iron cations. This reaction produces iron ions which dissolve and hydrogen as described above. Arrow 31 shows the solution being pumped out of the wellbore via fluid line 5 or via the well bore itself. This solution is fed into a separation unit 32 which comprises a gas/liquid separator to facilitate removal of hydrogen gas. The hydrogen gas is collected, and preferably measured, and sent for flare. The separation unit 32 also comprises a means to remove iron ions from the solution. After removal of $H_2$ and iron ions the solution is fed to a tank 6 from where it is injected back into the well bore.

EXAMPLES

Steel tubes for laboratory testing methods according to the first aspect of the present invention:

Pipes in alloy A106 grade B, in two dimensions as set out below, were used for testing:

¾" schedule pipe: 26.7 mm OD, 21.0 mm ID

3" schedule pipe: 88.9 mmm OD, 77.9 mm ID

The chemical compositions of the two different carbon steels are shown in Table 1 below. These alloys are similar to the steel typically used in well bore casing.

Flowing Velocity and Volume/Area Ratio for Laboratory Testing

By assuming equal mass transfer coefficients the relation between flow rates for pipes of two different diameters can be simplified as follows:

$$\frac{v_2}{v_1} = \left(\frac{D_2}{D_1}\right)^{0.25}$$

In the lab-tests the volume/weight ratio should ideally correspond to the ratio between the volume of solution/electrolyte and the amount of steel to be removed in actual use in a well bore. A volume/area ratio of 1.47 $m^3/m^2$ was calculated assuming that the solution/electrolyte is kept in 100 $m^3$ tanks and the internal surface area of 100 m of the casing 9⅗"×8½" to be removed is 68 $m^2$. For practical reasons, however, the testing had to be performed at lower volume/area ratios. For chemical and electrochemical dissolution tests the ratios used were 0.51, and 0.17 or 0.33 $m^3/m^2$, respectively.

Chemical Casing Removal

Experimental

Figure 5:
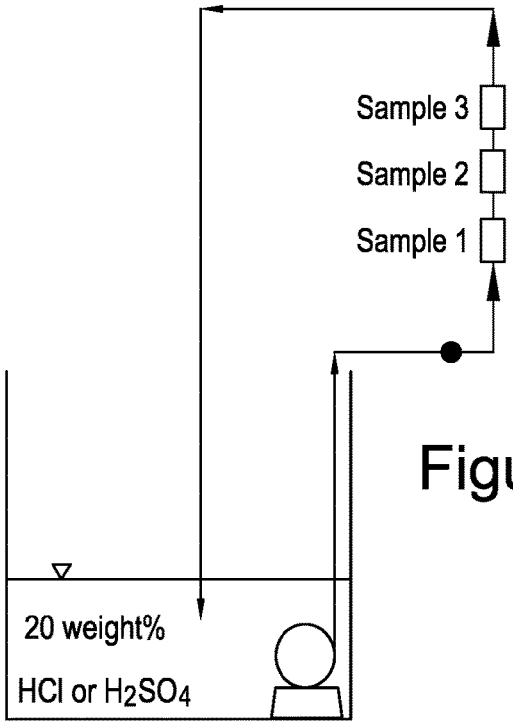
FIG. 5 is a schematic of the set up for dissolution testing of steel tube samples.

Chemical dissolution testing was carried out using a test setup, as shown in FIG. 5. Dissolution or corrosion rates of steel were determined from weight loss measurements of three cylindrical test samples cut from the ¾" schedule pipe. Samples 100 mm in length were cut. Three parallel samples were exposed in each test. The test solution was pumped from the reservoir and was flowing through the cylindrical test samples at constant flowing rate in accordance with the method of the first aspect of the present invention. Chemical dissolution rates are determined gravimetrically by weighing the test samples before and after exposure. Generally, uniform corrosion were observed in tests performed in the acidic test solutions.

Preliminary Testing

Preliminary test conditions used were:

20% HCl and 20% $H_2SO_4$ test solutions (no Fe content from start)

10 liter acidic solution

Ambient room temperature and 60° C.

Flowing rate estimated to 0.1 m/s (no flow meter was used)

1-3 days exposure

High dissolution rates were observed, particularly in tests performed at 60° C. Test results in HCl and $H_2SO_4$ solutions are summarized in Table 2 and Table 3 below, respectively. Average chemical dissolution rates for the two test solutions are compared in FIG. 6. The highest dissolution rates of the exposed carbon steel tubes were found for samples exposed in 20% $H_2SO_4$.

TABLE 1

| Alloy | % Cr | % Mo | % C | % Mn | % S | % Si | % P | % Cu |
|---|---|---|---|---|---|---|---|---|
| AISI4140 | 0.80-1.1 | 0.15-0.25 | 0.38-0.43 | 0.75-1.0 | 0.040 | 0.15-0.35 | 0.035 | |
| A106 gr. B | 0.4 | 0.15 | 0.30 | 0.29-1.26 | 0.035 | 0.10 | 0.035 | 0.40 |

TABLE 2

Chemical dissolution of steel tube samples in 20% HCl (1.10 g/cm$^3$)

| Temperature | Corrosion rate | | Dissolved Fe | | | $H_2$ (g) produced in lab tests | | 9⅝" × 8½" casing | |
|---|---|---|---|---|---|---|---|---|---|
| | | | At start | At end | As FeCl2 | No. of moles $H_2$ per l electrolyte | No. of moles $H_2$ per area steel tube | No. of moles $H_2$ per day on 100 m casing | Estimated time to dissolve |
| [° C.] | [kg/m$^2$, d] | [mm/d] | [g/l] | [g/l] | [g/l] | [mol/l] | [mol/m$^2$, d] | [mol/d] | [days] |
| RT | 1.9 | 0.24 ± 0.005 | 0 | 4 | 9 | 0.07 | 34 | 2317 | 59 |
| RT | 1.1 | 0.14 ± 0.01 | 4 | 10 | 23 | 0.11 | 19 | 1316 | 104 |
| 60 | 10.3 | 1.31 ± 0.04 | 10 | 31 | 70 | 0.37 | 185 | 12585 | 11 |
| 60 | 7.9 | 0.99 ± 0.01 | 31 | 46 | 108 | 0.28 | 141 | 9556 | 14 |

TABLE 3

Chemical dissolution of steel tube samples in 20% $H_2SO_4$ (1.17 g/cm$^3$)

| Temperature | Corrosion rate | | Dissolved Fe | | | $H_2$ (g) produced in lab tests | | 9⅝" × 8 ½" casing | |
|---|---|---|---|---|---|---|---|---|---|
| | | | At start | At end | As FeSO4 | No. of moles $H_2$ per l electrolyte | No. of moles $H_2$ per area steel tube | No. of moles $H_2$ per day on 100 m casing | Estimated time to dissolve |
| [9° C.] | [kg/m$^2$, d] | [mm/d] | [g/l] | [g/l] | [g/l] | [mol/l] | [mol/m$^2$, d] | [mol/d] | [days] |
| RT | 2.9 | 0.368 ± 0.005 | 0 | 6 | 17 | 0.10 | 52 | 3532 | 39 |
| 60 | 21.9 | 2.77 ± 0.001 | 6 | 49 | 142 | 0.77 | 391 | 26597 | 5.2 |
| 60 | 17.2 | 2.18 ± 0.02 | 49 | 77 | 224 | 0.51 | 307 | 20898 | 6.6 |

Figure 6:
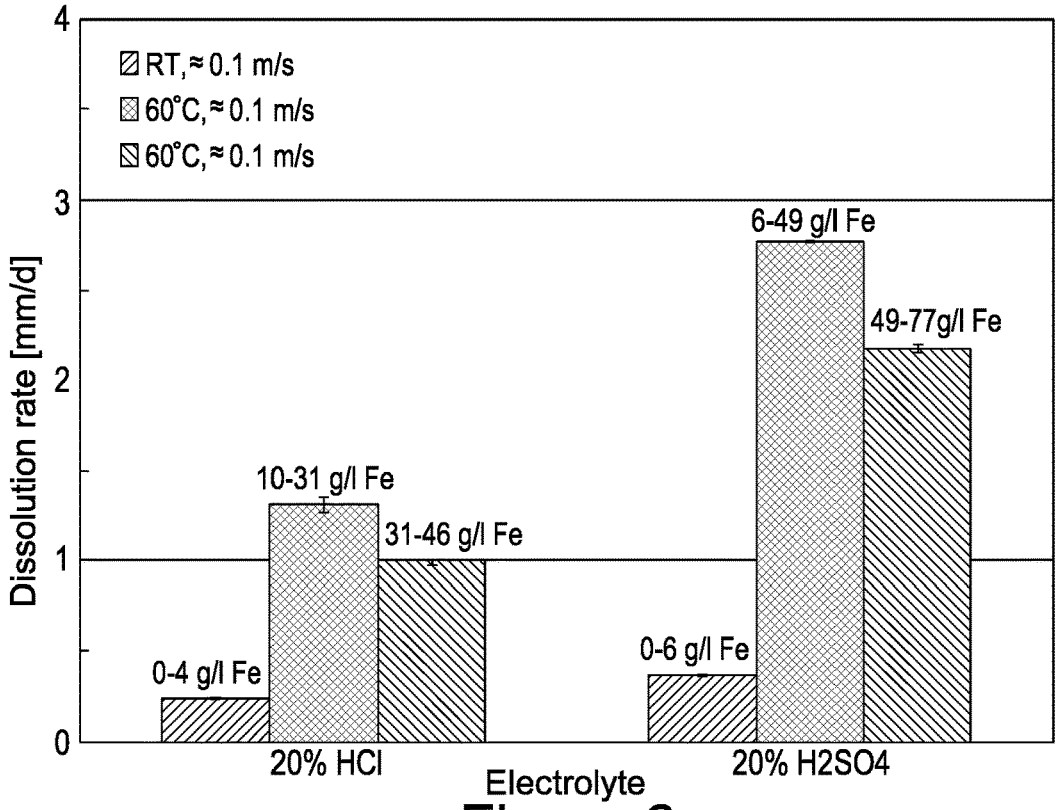
FIG. 6 shows a schematic of the reactions occurring during dissolution of steel in acidic conditions.

The change in Fe concentration in the test solutions determined from weight loss data are reported for each test in the two tables above and are also included as data labels in FIG. 6. Fe contents determined as $FeCl_2$ and $FeSO_4$ in the HCl and $H_2SO_4$ solutions, respectively, are also reported. The four HCl tests were carried out using the same HCl solution, indicating an increasing amount of dissolved Fe in the acidic test solution. Similarly, the three $H_2SO_4$ tests were performed in the same $H_2SO_4$ solution and thus with an increasing Fe content. Repeating tests in the HCl and $H_2SO_4$ solutions at 60° C. showed decreased dissolution rates. Both the increasing amount of dissolved iron in the solutions and the acid consumption due to $H_2$ evolution are assumed to affect the dissolution rate. Tests performed in 20% HCl at ambient room temperature showed that the dissolution rate decreased with increasing exposure time from 1 to 3 days.

Figure 7:
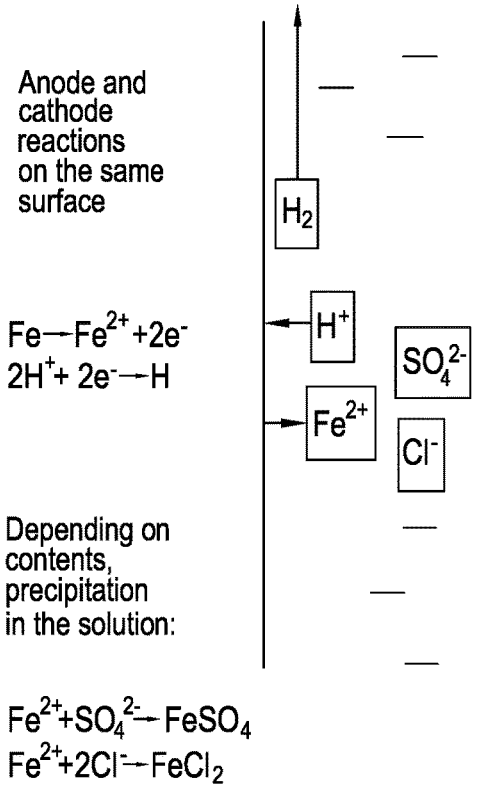
FIG. 7 shows a plot of average dissolution rate of steel tube samples in 20% HCl and 20% $H_2SO_4$ at different temperatures in an experiment performed according to the first aspect of the present invention.

Corrosion is an electrochemical reaction. In strong acids, iron dissolves anodically while $H_2$ evolution is the cathodic reaction occurring simultaneously at the steel surface, as described in FIG. 7. Total corrosion reaction is:

$$Fe+2H^+ \rightarrow Fe^2+H_2\ (g)$$

Depending on the test solution the total reaction can be rewritten $$Fe+2HCl \rightarrow FeCl_2(aq)+H_2\ (g)$$

$$Fe+H_2SO_4 \rightarrow FeSO_4(aq)+H_2\ (g)$$

Since gas is expanding when moving upwards (reduced hydrostatic pressure) inside the casing, the volume of $H_2(g)$ produced is important. Gas evolved during this testing has not been measured. According to the reactions above, stoichiometric amounts of $H_2(g)$ and dissolved $Fe^{2+}$ ions are produced. In Tables 2 and 3 above the amounts of $H_2(g)$ produced are determined both from the amount of Fe dissolved (mole/l) and from the corrosion rate (mole/m$^2$, day).

If the conditions for chemical dissolution in service are the same as the test conditions used, hydrogen production and time to dissolve casing in service can be estimated. For a section of a 9⅝"×8½" casing tube, 100 m in length the internal area is 68 m$^2$. Thus, if the ideal gas law is assumed, the reported dissolution rates indicate that the production of $H_2(g)$ will be a maximum of 470 m$^3$/day @25 C, 1 bara.

Times to dissolve a 100 m section of the 9⅝"×8½" casing tube are reported in Tables 2 and 3. The times are estimated by assuming steel dissolution rates in service equal to the rates determined from laboratory testing. The results indicate that dissolution rates of 5-6 days may be possible if a 20% $H_2SO_4$ solution is used as the acidic solution. The shortest dissolution time determined for a 20% HCl solution is 11 days.

Second Series Chemical Dissolution Tests

The test matrix for further chemical dissolution testing on a test set up for a method according to the first aspect of the present invention is shown in Table 4.

TABLE 4

Further chemical dissolution testing at 60° C.

| Acid/salt solution | Exposure time [hours] | | Flowing rate[1] [m/s] 0.05 | 0.1 | 0.14 | 0.24 |
|---|---|---|---|---|---|---|
| 20% $H_2SO_4$ | 6 | — | x | 2x | — | — |
| | — | 20 | — | 2x | x | x |
| 20% NaCl + 20% $H_2SO_4$ | 6 | 20 | — | x | — | — |
| 20% HCl | — | 20 | 2x | 2x | — | — |
| 20% HCl + 20% NaCl | — | 20 | — | 2x | — | — |

[1]2x indicates that the test has been performed two times

The dissolution testing was carried out at 60° C. using the same test set up as the introductory testing (FIG. 5). The effect of flow rate was investigated. Flowing rates in the range 0.05-0.2 m/s were estimated by down-scaling flowing rates typical for wells. Testing at a lower flowing rates was included in order to evaluate conditions with growing gas bubbles. Three parallel samples cut from the ¾" schedule pipe were exposed in each test. Dissolution rates are determined from average weight loss of parallel test samples. Test solutions used were prepared as shown in Table 5 below.

TABLE 5

Preparation of test solutions

| Electrolyte | Concentrated acid [l] | Water [l] | NaCl [kg] | Acid contents Vol % | Acid contents Weight % | Density [kg/l] |
|---|---|---|---|---|---|---|
| 20% HCl | 5.3 | 4.7 | | 20 | 21 | 1.10 |
| 20% HCl + 20 wt % NaCl | 5.3 | 4.7 | | 20 | 18 | 1.19 |
| 20% $H_2SO_4$ | 4 | 16 | | 20 | 31 | 1.17 |
| 20% $H_2SO_4$ + 20 wt % NaCl | 4 | 14 | 4.0 | 20 | 28 | 1.28 |
| 20% $H_2SO_4$ + 3.5 wt % NaCl | 4 | 16 | 0.7 | 20 | 30 | 1.18 |
| 20 wt % NaCl | | 18 | 4.0 | | | 1.11 |

Results of the Second Series Tests

Exposure in Sulphuric Acid Based Solutions

Results of chemical dissolution testing of carbon steel tubes in 20% $H_2SO_4$ and 20% $H_2SO_4$ containing 20 wt % NaCl are shown in Table 6 and Table 7, respectively.

Figure 8:
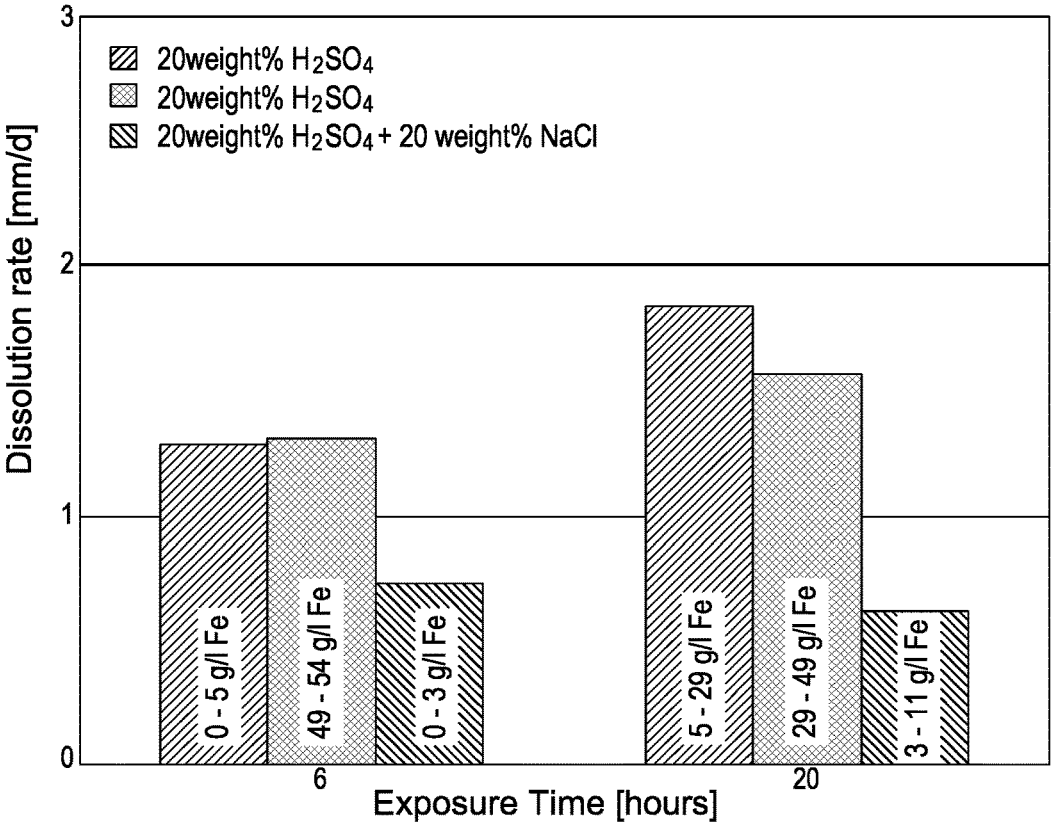
FIG. 8 is a bar graph showing the effect of exposure time and addition of 20% NaCl on chemical dissolution of carbon steel in 20% $H_2SO_4$ at 0.1 m/s flow rate and 60° C. in an experiment performed according to the first aspect of the present invention.

Corrosion rates in the range 1.1-1.8 mm/d were determined for samples exposed in 20% $H_2SO_4$ and 0.6-0.7 mm/d for samples exposed in 20% $H_2SO_4$ containing NaCl. This is clearly shown in FIG. 8 which also shows the effect of exposure time in the same test solutions. Tests carried out in 20% $H_2SO_4$ without any NaCl present showed increased dissolution rate with increasing exposure time from 6 to 20 hours. This is probably due to the presence of an oxide or mill scale on the steel tube surfaces protecting the steel surface towards corrosion. In agreement with the results from the introductory testing, the 20 hours exposure in 20% $H_2SO_4$ showed a certain reduction in the dissolution rates with increasing Fe content in the test solutions. In the

TABLE 6

Chemical dissolution of carbon steel in 20% $H_2SO_4$ at 60° C.

| Exposure time [days] | Flowing rate [m/s] | Corrosion rate [kg/m², d] | Corrosion rate [mm/d] | Dissolved Fe At start [g/l] | Dissolved Fe At end [g/l] | Dissolved Fe As $FeSO_4$ [g/l] | $H_2$ (g) produced in labtests No. of moles $H_2$ per l electrolyte [mol/l, d] | $H_2$ (g) produced in labtests No. of moles $H_2$ per area steel tube [mol/m², d] | 9⅝" × 8½" casing No. of moles $H_2$ per day 100 m casing [mol/d] | 9⅝" × 8½" casing Estimated time to dissolve [days] |
|---|---|---|---|---|---|---|---|---|---|---|
| 0.25 | 0.10 | 10.13 | 1.28 ± 0.03 | 0 | 5 | 14 | 0.36 | 181 | 12324 | 13 |
| 0.83 | 0.10 | 14.53 | 1.84 ± 0.04 | 5 | 29 | 79 | 0.51 | 260 | 17673 | 7.8 |
| 0.83 | 0.10 | 12.37 | 1.57 ± 0.05 | 29 | 49 | 134 | 0.44 | 221 | 15043 | 9.1 |
| 0.25 | 0.10 | 10.34 | 1.30 ± 0.08 | 49 | 54 | 148 | 0.37 | 185 | 12573 | 11 |
| 0.83 | 0.14 | 12.27 | 1.53 ± 0.05 | 54 | 75 | 203 | 0.43 | 220 | 14927 | 9.2 |
| 0.25 | 0.05 | 8.65 | 1.10 ± 0.03 | 75 | 79 | 215 | 0.31 | 155 | 10528 | 13 |
| 0.83 | 0.24 | 13.12 | 1.66 ± 0.02 | 0 | 22 | 59 | 0.46 | 235 | 15954 | 8.6 |

TABLE 7

Chemical dissolution of carbon steel in 20% $H_2SO_4$ + 20% NaCl at 60° C.

| Exposure time [days] | Flowing rate [m/l] | Corrosion rate [kg/m², d] | Corrosion rate [mm/d] | Dissolved Fe At start [g/l] | Dissolved Fe At end [g/l] | Dissolved Fe As $FeSO_4$ [g/l] | $H_2$ (g) produced in labtests No. of moles $H_2$ per l electrolyte [mol/l, d] | $H_2$ (g) produced in labtests No. of moles $H_2$ per area steel tube [mol/m², d] | 9⅝" × 8½" casing No. of moles $H_2$ per day on 100 m casing [mol/d] | 9⅝" × 8½" casing Estimated time to dissolve [days] |
|---|---|---|---|---|---|---|---|---|---|---|
| 0.25 | 0.1 | 5.74 | 0.73 ± 0.05 | 0 | 3 | 7 | 0.18 | 103 | 6981 | 20 |
| 1 | 0.1 | 4.45 | 0.82 ± 0.08 | 3 | 10 | 26 | 0.13 | 80 | 5408 | 23 |

presence of NaCl, however, no clear effect of either increased exposure time or increased Fe content in the solution was seen.

Figure 9A:
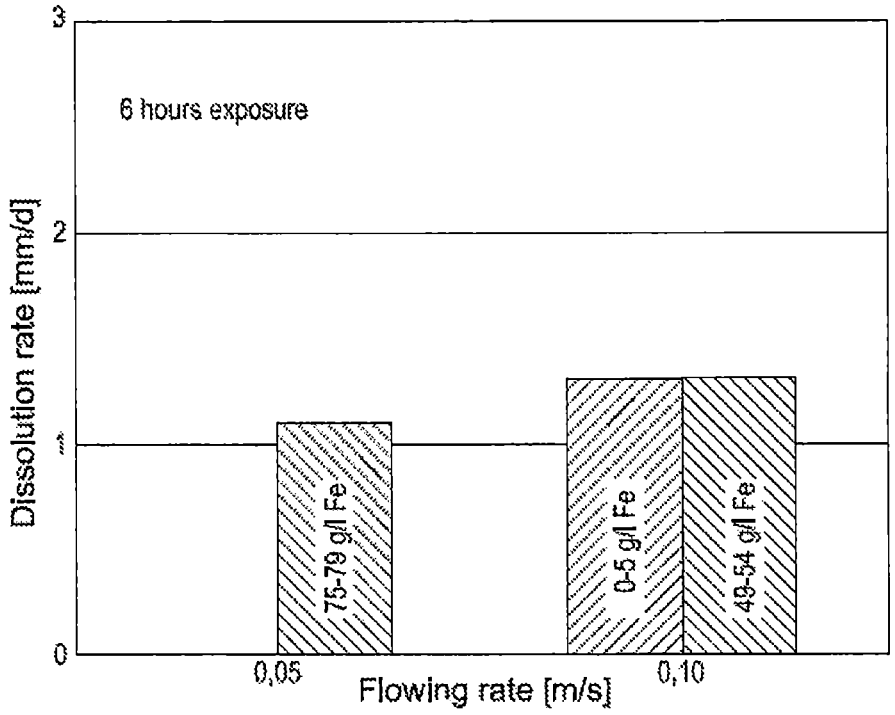
FIGS. 9*a* and 9*b* are bar charts showing the effect of flowing rate on chemical dissolution of carbon steel in 20% $H_2SO_4$ at 60° C. for 6 hours (FIG. 9*a*) and 20 hours (FIG. 9*b*) exposure tests in an experiment performed according to the first aspect of the present invention.
Figure 9B:
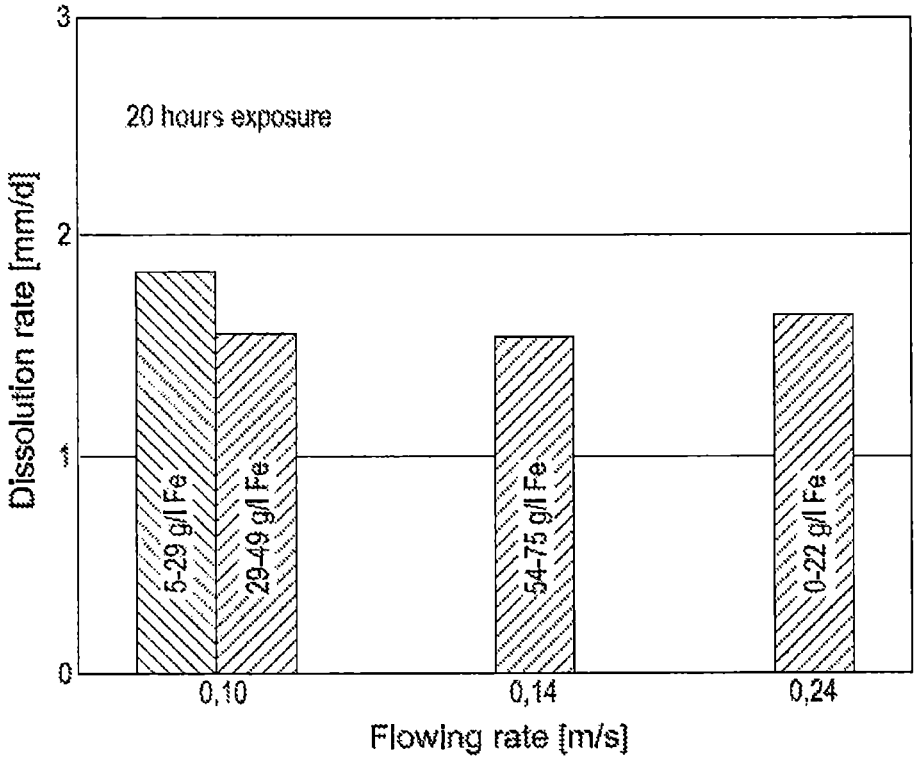

As shown in FIG. 9, the results show no clear effect of increasing flowing rate in the range 0.05 to 1.4 m/s on the dissolution rate of steel tubes in 20% $H_2SO_4$.

Exposure in Hydrochloric Based Solutions

Results of chemical dissolution testing of carbon steel tubes in 20% HCl and 20% HCl containing 20 wt % NaCl are shown in Table 8 and Table 9 respectively.

Steel Tubes for Laboratory Testing

Pipes in the alloys and dimensions as set out below were used for testing methods according to the third aspect of the present invention:

3½" pipes of 13Cr L80

3½" pipes of C-steel L80

The chemical compositions of these alloys are shown in Table 10 below. The pipes are meant for use as casing or tubing for wells in accordance to API Specification 5CT/ISO 11960:2001.

TABLE 8

Chemical dissolution of carbon steel samples in 20% HCl at 60° C.

| | | | | Dissolved Fe | | | $H_2$ (g) produced in labtests | | 9⅝" × 8½" casing | |
|---|---|---|---|---|---|---|---|---|---|---|
| Exposure time | Flowing rate | Corrosion rate | | At start | At end | As $FeSO_4$ | No. of moles $H_2$ per l electrolyte | No. of moles $H_2$ per area steel tube | No. of moles $H_2$ per day on 100 m casing | Estimated time to dissolve |
| [days] | [m/s] | [kg/m², d] | [mm/d] | [g/l] | [g/l] | [g/l] | [mol/l, d] | [mol/m², d] | [mol/d] | [days] |
| 5 | 0.05 | 5.30 | 0.67 ± 0.06 | 0 | 10 | 24 | 0.19 | 95 | 6445 | 21 |
| 2 | 0.05 | 6.16 | 0.39 ± 0.01 | 10 | 23 | 51 | 0.22 | 110 | 7498 | 18 |
| 3 | 0.10 | 12.14 | 1.54 ± 0.004 | 0 | 24 | 54 | 0.43 | 217 | 14765 | 9.3 |
| 2 | 0.10 | 7.38 | 0.93 ± 0.02 | 24 | 39 | 88 | 0.26 | 132 | 8977 | 15 |

TABLE 9

Chemical dissolution of carbon steel samples in 20% HCl + 20% NaCl at 60° C.

| | | | | Dissolved Fe | | | $H_2$ (g) produced in labtests | | 9⅝" × 8½" casing | |
|---|---|---|---|---|---|---|---|---|---|---|
| Exposure time | Flowing rate | Corrosion rate | | At start | At end | As $FeSO_4$ | No. of moles $H_2$ per l electrolyte | No. of moles $H_2$ per area steel tube | No. of moles $H_2$ per day on 100 m casing | Estimated time to dissolve |
| [days] | [m/s] | [kg/m², d] | [mm/d] | [g/l] | [g/l] | [g/l] | [mol/l, d] | [mol/m², d] | [mol/d] | [days] |
| 1 | 0.1 | 14.96 | 1.89 ± 0.06 | 0 | 30 | 67 | 0.37 | 268 | 18201 | 7.6 |
| 1 | 0.1 | 9.74 | 1.23 ± 0.08 | 30 | 49 | 111 | 0.28 | 174 | 11847 | 12 |

Figure 10:
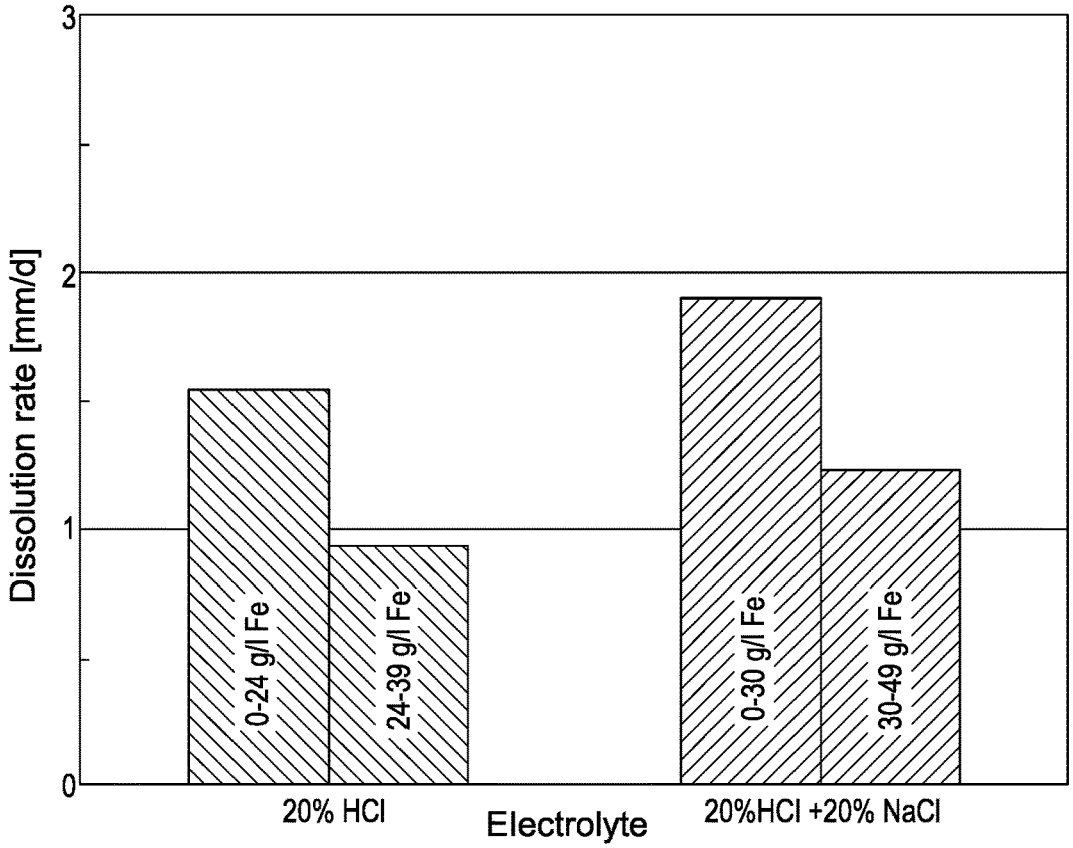
FIG. 10 is a bar chart showing the effect of addition of 20% NaCl to 20% HCl on chemical dissolution of carbon steel at 0.1 m/s flowing rate and 60° C. in an experiment performed according to the first aspect of the present invention.
Figure 11:
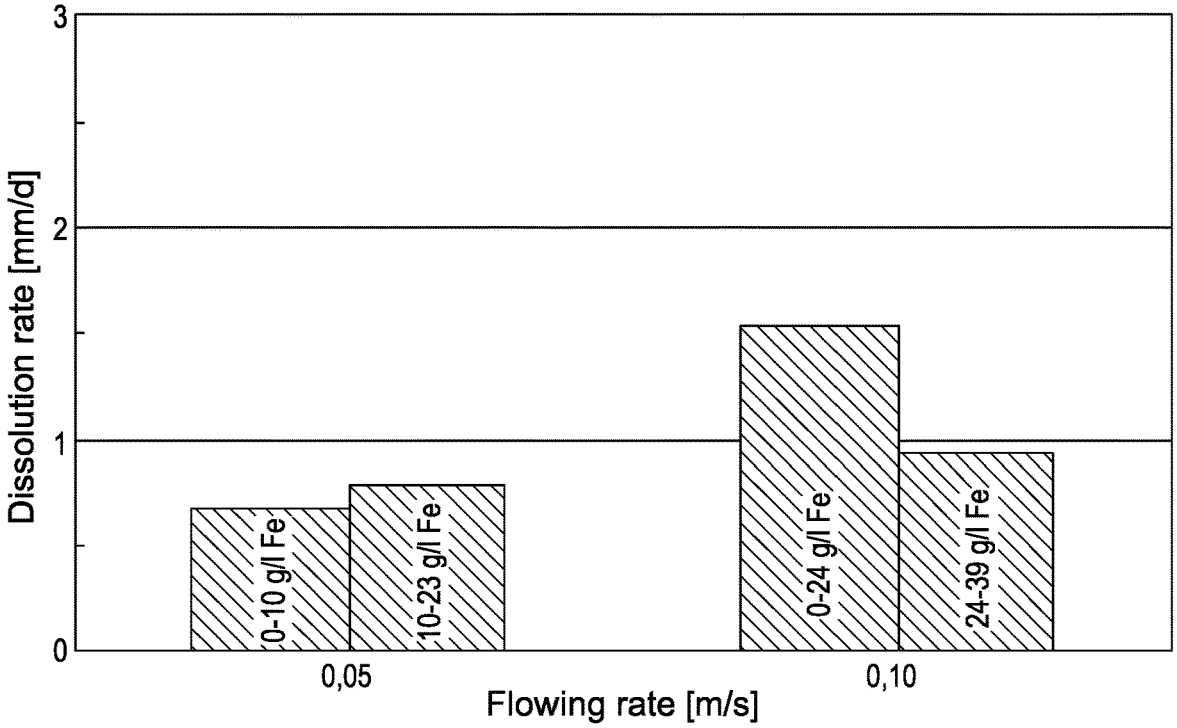
FIG. 11 is a bar chart showing the effect of flowing rate on chemical dissolution of carbon steel in 20% HCl at 60° C., 24 hours exposure in an experiment performed according to the first aspect of the present invention.

Corrosion rates in the range 0.4-1.5 mm/yr was found in HCl without NaCl present. In NaCl containing solutions the determined corrosion rates were 1.2 and 1.9 mm/yr indicating increased steel dissolution in the presence of NaCl. This effect is clearly shown in FIG. 10, and may be explained by the increased chloride content resulting in iron high solubility in the acidic test solution. As shown in FIG. 11, the dissolution rate of carbon steel in hydrochloric solutions increases with increasing flowing rate from 0.05 to 0.1 m/s. The dissolution data obtained at 0.1 m/s flowing showed reduced dissolution rate with increasing iron content in the test solution.

TABLE 10

| Alloy | C | Mn | Cr | Ni | Cu | P | S | Si |
|---|---|---|---|---|---|---|---|---|
| 13Cr L80 | 0.150-0.220 | 0.250-1.000 | 12.000-14.000 | 0.500 | 0.250 | 0.020 | 0.010 | 1.000 |
| L80 | 0.430 | 1.900 | — | 0.250 | 0.350 | 0.030 | 0.030 | 0.450 |

The pipes were cut into 150 mm rings. Test samples were then cut in 150 mm lengths. The sample areas were determined based on a volume/area ratio of 5.4 ml/cm², which has been calculated for the dissolution of a casing of dimensions 9⅝"×8½" in service. The determined sample size for L80 and 13Cr L80 are shown in Table 11 and Table 12, respectively.

TABLE 11

| Casing removal: L80, L = 450 mm Ø = 115 mm Wt = 7.0 mm | | | | | | |
|---|---|---|---|---|---|---|
| 15 cm high rings | External width, cm | Internal width, cm | Sample areal, cm^2 | Test volume, l | Test volume included samples, l | Level of electrolyte, cm |
| Each ring cut in 7 samples | 5.2 | 4.5 | 159 | 2.6 | 2.7 | 16.3 |
| Volum/areal-forhold | 5.4 ml/cm2 | | | | | |

TABLE 12

| Casing removal: 13CrL80, L = 450 mm Ø = 90 mm Wt = 7.0 mm | | | | | | |
|---|---|---|---|---|---|---|
| 15 cm high rings | External width, cm | Internal width, cm | Sample areal, cm^2 | Test volume, l | Test volume included samples, l | Level of electrolyte, cm |
| Each ring cut in 7 samples | 5.7 | 4.8 | 171 | 2.8 | 2.9 | 17.5 |
| Volum/areal-forhold | 5.4 ml/cm2 | | | | | |

A hole was drilled in each sample, acting as point of suspension during testing. Prior to testing the samples were machined as follows:

Surface mill scales were removed

On outer surface of L80

On outer and inner surface of 13Cr

Sharp edges were rounded by grinding

These pipes are used for testing the method in accordance with the third aspect of the present invention.

Experimental

Figure 16:
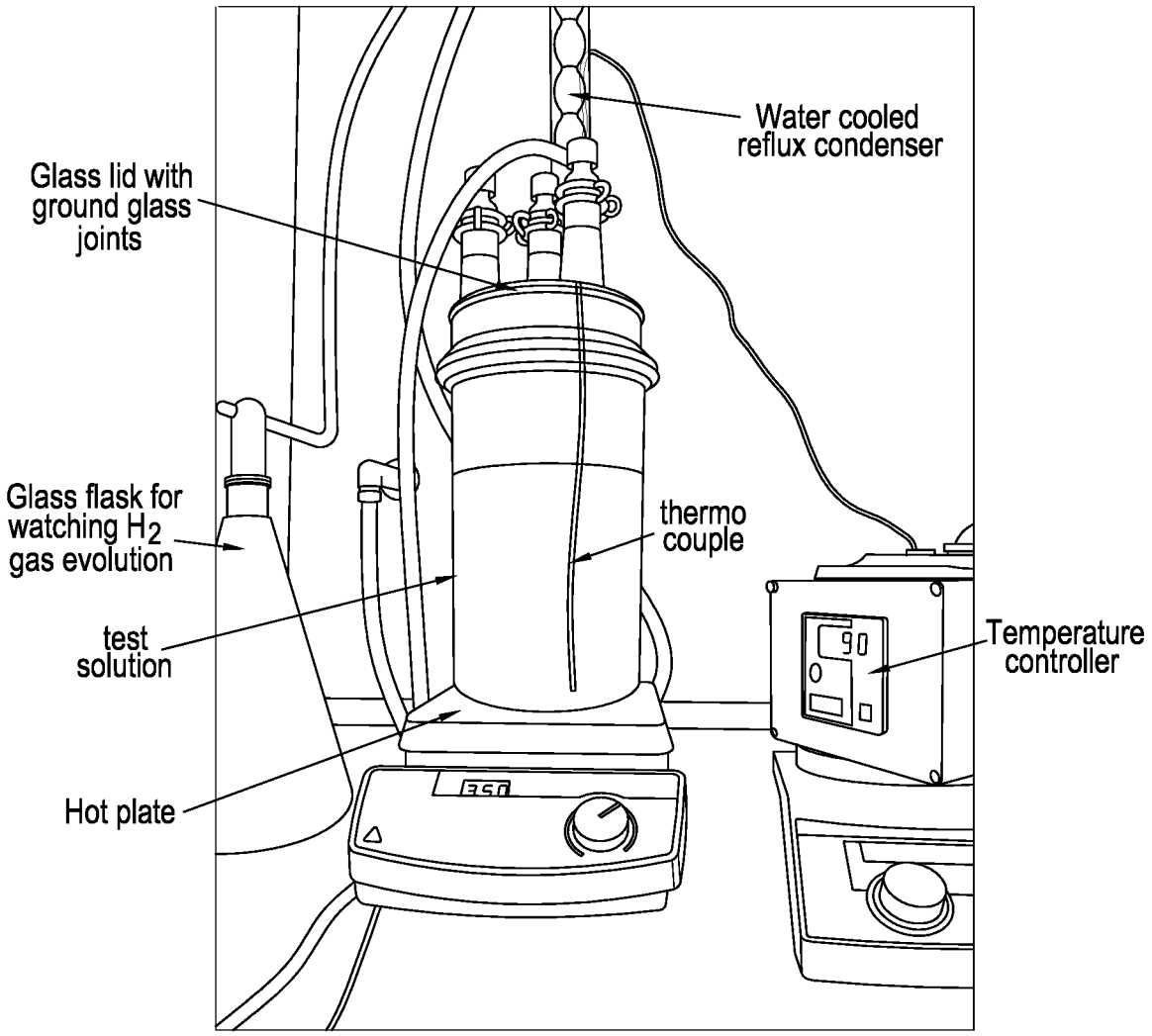
FIG. 16 shows the experimental setup used to determine dissolution rates for methods of the third aspect of the present.

Chemical dissolution testing was carried out using a test setup, as shown in FIG. 16. A glass autoclave (3 litres in size) was used as test cell. The cell had a lid with ground joints and a water cooled reflux condenser to avoid evaporation of test solution during testing. Exposure times used were 2, 4, 8, and 20 hours. Additionally, one test was performed at ambient temperature. The rate and extent of dissolution was determined gravimetrically from weight loss data.

Exemplary densities of fluids that were used in testing are as follows:

20% HCl+5% NaCl, ca. 1.12 g/cm$^3$

20% HCl+20% NaCl, ca. 1.19 g/cm$^3$

1M H3PO3, ca. 1.03 g/cm$^3$

2M H3PO3, ca. 1.07 g/cm$^3$

The Dissolution Reaction

Corrosion is an electrochemical reaction. In strong acids, iron dissolves anodically while $H_2$ evolution is the cathodic reaction occurring simultaneously at the steel surface, as described in FIG. 7. Total corrosion reaction is:

$$Fe+2H^+ \rightarrow Fe^2+H_2\ (g)$$

Depending on the test solution the total reaction can be rewritten $$Fe+2HCl \rightarrow FeCl_2(aq)+H_2\ (g)$$

$$Fe+H_2SO_4 \rightarrow FeSO_4(aq)+H_2\ (g)$$

In HCl based solutions, iron chloride may precipitate:

$$Fe+2HCl=FeCl_2+H_2$$

In oxygen rich environments the ferrous iron ion ($Fe^{2+}$) is unstable. $Fe^{2+}$ is then oxidized to $Fe^{3+}$ (ferric ion). Low $O_2$ in wells indicates that only $Fe^{2+}$ ions are formed.

The reaction enthalpy for the dissolution reaction above determined using the equation below shows that the reaction is producing heat, i.e., it is an exothermic reaction, $\Delta H_5=-88$ kJ/mole.

$$\Delta H_r=\Delta H_f(Fe^{2+})+\Delta H_f(H_2)-\Delta H_f(Fe)-\Delta H_f(H^+)$$

$$\Delta H_f(Fe^{2+})=-88\ \text{kJ/mole}\ \Delta H_f(H_2)=0$$

$$\Delta H_f(Fe)=0\ \Delta H_f(H^+)=0$$

L80 Steel

Figure 17:
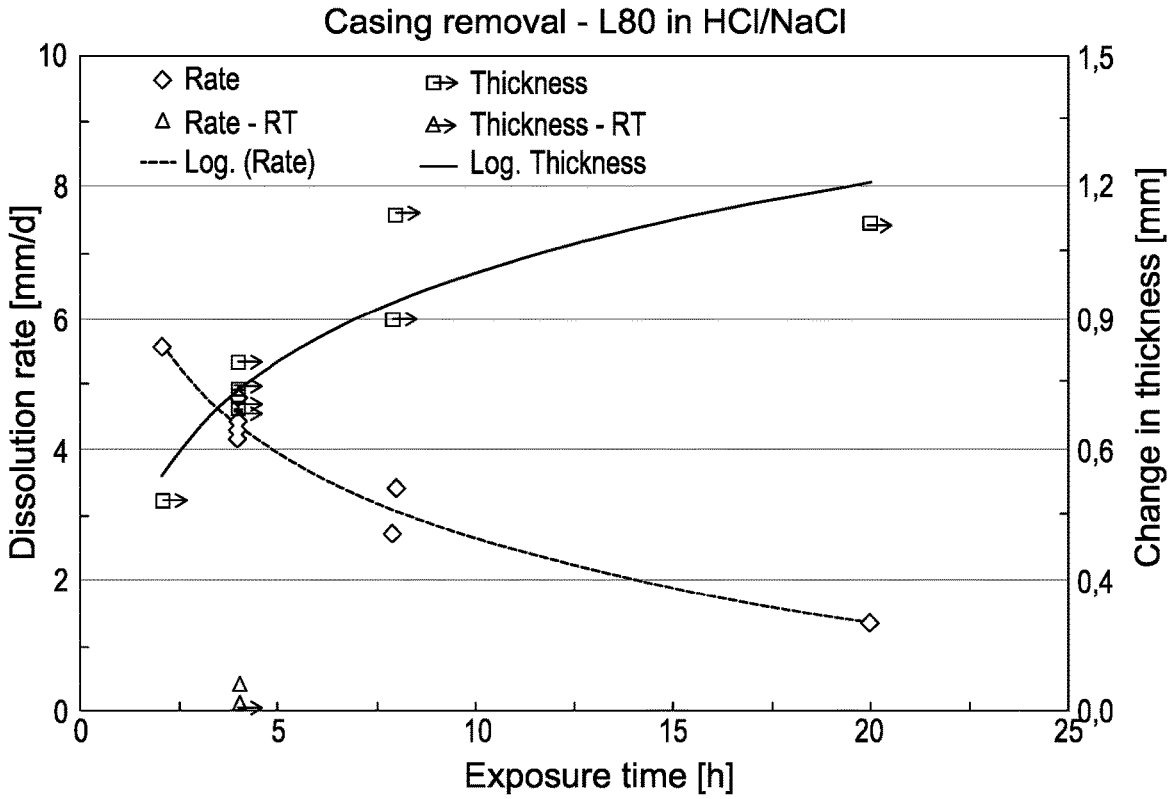
FIG. 17 shows a plot of the dissolution rate of L80 steel in HCl/NaCl solutions at 20 and 90° C. as a function of exposure time in an experiment performed according to the third aspect of the present invention.
Figure 18:
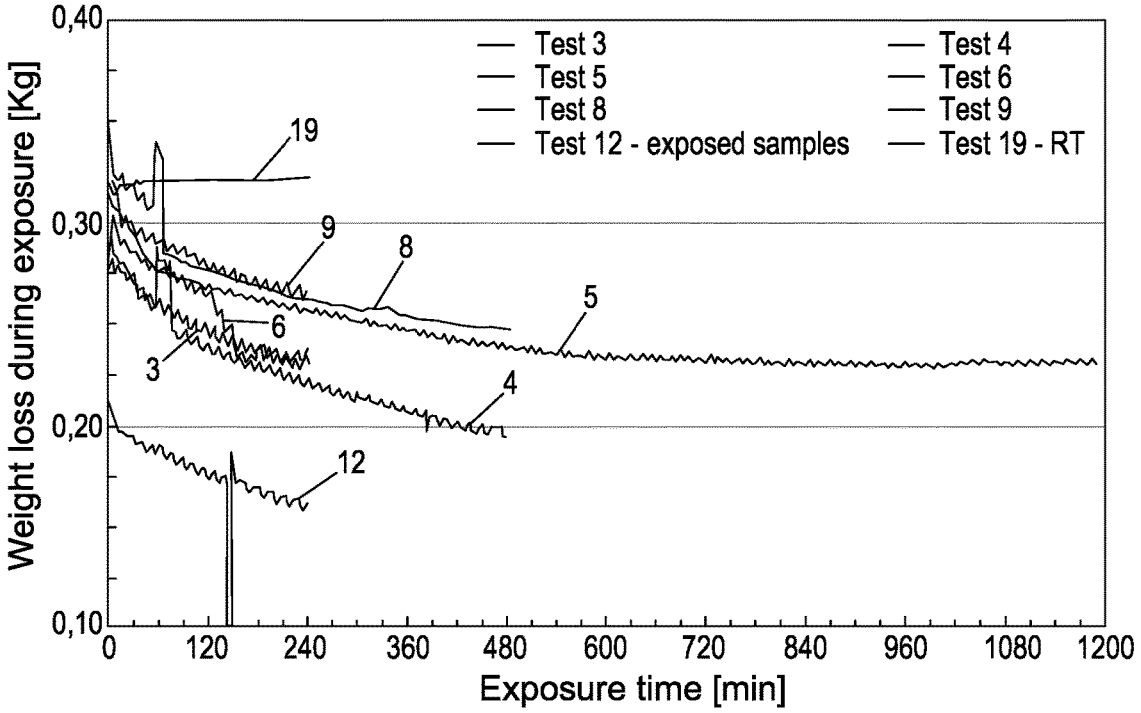
FIG. 18 shows a plot of continuous weight loss measurements for dissolution testing of L80 steel in NaCl/HCl solutions at 20 and 90° C. in an experiment performed according to the third aspect of the present invention.

The density used for L80 steel ($d_{steel}$) for gravimetric determination of weight loss was 7.8 g/cm$^3$. The results of dissolution testing of the L80 steel in HCl/NaCl solutions according to a third aspect of the present invention at ambient room temperature and 90° C. are summarized in Table 13. The dissolution rate and the change in steel pipe thickness as functions of exposure time are shown in FIG. 17. In addition, weight change for one of the samples in each test was measured continuously as shown in FIG. 18.

TABLE 13

| Electrolyte: 20% HCl+ | Test no | Exposure time [hours] | Average temperature [° C.] | Average steel thickness removal [mm] | Average dissolution rate [mm/day] |
|---|---|---|---|---|---|
| 20% NaCl | 1 | 2.08 | 90 | 0.48 ± 0.01 | 5.6 ± 0.2 |
| 20% NaCl | 2 | 4.00 | 90 | 0.73 ± 0.03 | 4.4 ± 0.2 |
| 20% NaCl | 3 | 4.00 | 89 | 0.71 ± 0.01 | 4.3 ± 0.1 |
| 20% NaCl | 6 | 4.00 | 89 | 0.80 ± 0.03 | 4.8 ± 0.2 |
| 5% NaCl | 9 | 4.00 | 90 | 0.72 ± 0.01 | 4.3 ± 0.1 |
| 5% NaCl | 12 | 4.00 | 89 | 0.70 ± 0.03 | 4.2 ± 0.2 |
| 5% NaCl | 8 | 7.92 | 86 | 0.90 ± 0.02 | 2.7 ± 0.1 |
| 20% NaCl | 4 | 8.00 | 92 | 1.14 ± 0.04 | 3.4 ± 0.1 |

TABLE 13-continued

| Electrolyte: 20% HCl+ | Test no | Exposure time [hours] | Average temperature [° C.] | Average steel thickness removal [mm] | Average dissolution rate [mm/day] |
|---|---|---|---|---|---|
| 20% NaCl | 5 | 20.00 | 89 | 1.12 ± 0.00 | 1.34 ± 0.01 |
| 5% NaCl | 19 | 4.02 | 21 | 0.01 ± 0.00 | 0.06 ± 0.02 |

$H_2$ gas evolution determined gravimetrically from weight loss data is shown in Table 14. The weight loss data was used to calculate $H_2$ gas evolution in the lab test is also shown in Table 14. The test samples exposed in test 12 are the same as exposed in Test 4.

TABLE 14

| | Dissolution of steel L80 | | | | Amount $H_2$ produced | | | |
|---|---|---|---|---|---|---|---|---|
| | | | | | | | 9⅝ × 8½ casing | |
| | Exposure time | Temperature | Fe in solution | | Lab test | | 67.8 $m^2$ per 100 m length | |
| Test | [h] | [° C.] | [g/l] | [mol/l] | [mol/l, h] | [mol/$dm^2$, h] | mol/h | $m^3$/h |
| TEST 1 | 2.08 | 90 | 67 | 1.19 | 0.57 | 0.31 | 2098 | 51 |
| TEST 2 | 4.00 | 90 | 102 | 1.82 | 0.46 | 0.25 | 1669 | 41 |
| TEST 3 | 4.00 | 89 | 99 | 1.76 | 0.44 | 0.24 | 1615 | 40 |
| TEST 6 | 4.00 | 89 | 110 | 1.98 | 0.49 | 0.27 | 1809 | 44 |
| TEST 9 | 4.00 | 90 | 100 | 1.78 | 0.45 | 0.24 | 1633 | 40 |
| TEST 12 | 4.00 | 89 | 96 | 1.72 | 0.43 | 0.23 | 1572 | 38 |
| TEST 4 | 8.00 | 92 | 157 | 2.81 | 0.35 | 0.19 | 1284 | 31 |
| TEST 8 | 7.92 | 86 | 124 | 2.22 | 0.28 | 0.15 | 1027 | 25 |
| TEST 5 | 20.00 | 89 | 154 | 2.75 | 0.14 | 0.07 | 504 | 12.3 |

Furthermore, the data was used to determine $H_2$ gas evolution in 100 m of a 9⅝"×8½" casing pipe. The results indicate that the average evolution rate of $H_2$ after 2 hours exposure will be 51 $m^3$/hour.

As can be seen from Table 14, the dissolution rate decreased with increased exposure time. After 2 hours exposure time, 0.48 mm of the material thickness was dissolved. Approximately 1 mm of the L80 steel pipe was removed after 8 hours exposure. Exposure beyond 10 hours in resulted in little or no steel removal.

The results show minor effects of the amount of NaCl (5 or 20 wt %) added to the 20 wt % HCl solution. The results shown in Table 13 do not show any effect of exposing etched samples to the HCl solution compared to ground samples.

An undesirable effect of using acidic solutions for casing removal may be direct contact between the solutions and the upper part of the casing when feeding solutions into the well, i.e. at ambient temperature. Weight loss data for L80 steel samples at ambient room temperature showed an average dissolution rate of 0.06 mm/day or removal of approximately 0.01 mm metal after 4 hours exposure.

The temperature, pH, i.e. concentration of $H^+$ ions in the solution, and the solubility of $FeCl_2$ in the HCl based solutions are the main factors affecting the dissolution rate of L80 steel in the HCl based electrolyte.

The results of the gravimetric analysis were verified by inductively coupled plasma (ICP) analysis. Generally, the analysed Fe values were about 10% higher than Fe contents determined gravimetrically from weight loss data of the L80 samples exposed to HCl/NaCl solutions, as shown in Table 15. The higher Fe contents in the ICP analysis are probably due to evaporation from the acidic solution after testing. When the steel samples were removed from the test cell, the lid and water cooled reflux condenser was not replaced. Hence, some of the test solution evaporated into the fume hood during cooling.

TABLE 15

| | | | | Fe in solution | | | |
|---|---|---|---|---|---|---|---|
| | Electrolyte: | Exposure time | Temperature | Determined | Analysis Molab | | Difference [%] |
| Test | 20% HCl+ | [hours] | [° C.] | [g/l] | [% Fe løst] | [g/l] | analysed/determined |
| TEST 1 | 20% NaCl | 2.08 | 90 | 67 | 6.8 | 68 | 2.0 |
| TEST 2 | 20% NaCl | 4.00 | 90 | 102 | 11.2 | 112 | 10.0 |
| TEST 3 | 20% NaCl | 4.00 | 89 | 99 | 10.6 | 106 | 7.6 |
| TEST 6 | 20% NaCl | 4.00 | 89 | 110 | 12.3 | 123 | 11.4 |
| TEST 9 | 5% NaCl | 4.00 | 90 | 100 | 11.0 | 110 | 10.4 |
| TEST 12 | 5% NaCl | 4.00 | 89 | 96 | 10.5 | 105 | 9.5 |
| TEST 4 | 5% NaCl | 8.00 | 92 | 157 | 17.0 | 170 | 8.5 |
| TEST 8 | 20% NaCl | 7.92 | 86 | 124 | 13.1 | 131 | 5.6 |
| TEST 5 | 20% NaCl | 20.00 | 89 | 154 | 17.4 | 174 | 13.2 |

Figure 19:
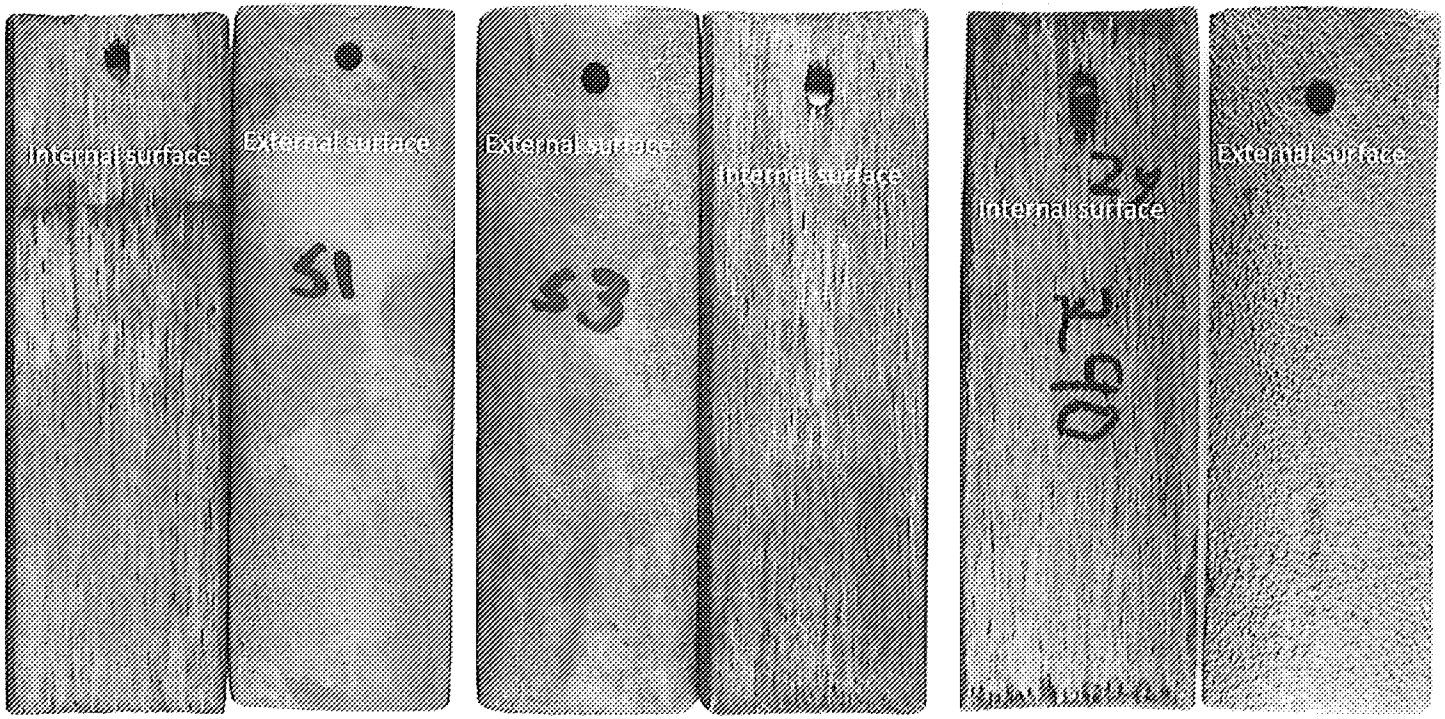
FIG. 19 shows samples of L80 steel exposed for 2, 4, and 8 hours in HCl/NaCl dissolution tests.

Visual examination of exposed samples indicated different surface appearances for the two sides of the L80 steel samples. The exposed samples are shown in FIG. 19. It can be seen that:

The external surface was uniformly etched; and

The internal surface had a longitudinal etching appearance.

The etching appearance connected to the short edges and holes in the samples was particularly different between the two sample sides. The treatment of samples prior to testing is assumed to be one reason for the observed differences. Mill scale present at the external sample surfaces was removed and sample edges were rounded by grinding prior to testing (as discussed above), while the internal surface of the samples was exposed as received, i.e. without removal of mill scale. It is also possible that the microstructure of the different samples is responsible for the longitudinal etching at the internal side of the samples.

Figure 20:
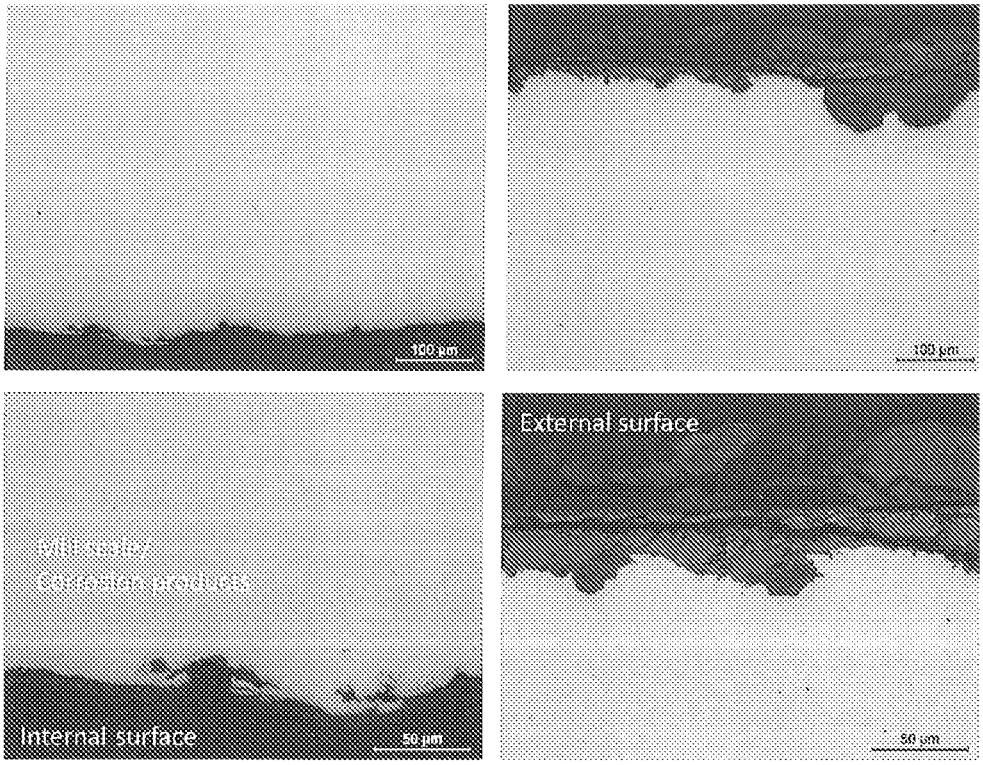
FIG. 20 shows micrographs of internal and external surfaces of L80 steel in two magnifications.

To verify this, cross section of the L80 steel samples were prepared perpendicular to the length of the pipes. Micrographs of internal and external surfaces are shown in FIG. 20.

Scaling/corrosion products are seen on the rough external surface. The internal surface seems to be less rough compared to the external surface. Additionally, less scaling/corrosion products are visible. The corrosion products at the external surface were removed by grinding prior to testing, while the internal surface was exposed without grinding.

Figure 21:
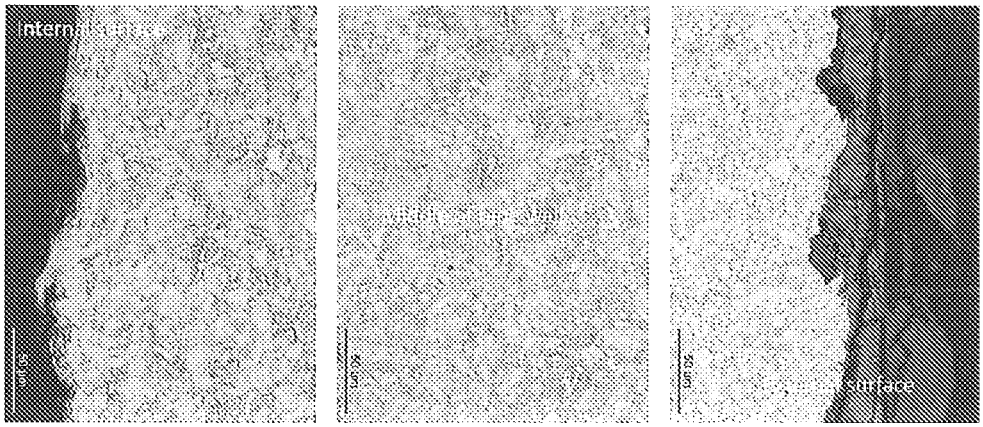
FIG. 21 shows micrographs of the microstructure through an L80 pipe wall in positions at internal and external surfaces and in the middle of the pipe wall after dissolution testing performed according to the third aspect of the present invention.

To study the microstructure of external and internal surfaces the cross section samples were etched in 10% oxalic acid. FIG. 21 shows microstructure in three different positions:

Internal surface

In the middle of the pipe wall

External surface

TABLE 16

| Compounds | Conc [g/l] | Conc [mole/l] | pH = − Log [$H^+$] |
|---|---|---|---|
| 20 wt % HCl | 220 | 6.02 | |
| 5 wt % NaCl | 50 | 0.86 | |
| [$Cl^-$] = [HCl] + [NaCl] | | 6.88 | |
| [$Na^+$] = [NaCl] | | 0.86 | |
| [$H^+$]~[HCl] | | 6.02 | −0.78 |
| Kw = [H+] · [OH−] = $10^{-14}$ | [OH−] = $10^{-14}$/[$H^+$] << [$H^+$] | | |
| Electron neutrality—EN | [$H^+$] + [Na+] = [$Cl^-$] + [OH−]~[$Cl^-$] | | |

The amount of $H^+$ ions consumed in the dissolution process was estimated from the average weight loss data of L80 steel after 2, 4, 8, and 20 hours exposure, as shown in Table 17.

TABLE 17

| Exposure time [h] | Dissolved Fe/ produced $H_2$ [mol/l] | Used $H^+$ [mol/l] |
|---|---|---|
| 2 | 1.19 | 2.38 |
| 4 | 1.81 | 3.63 |
| 8 | 2.51 | 5.03 |
| 20 | 2.75 | 5.50 |

Figure 23:
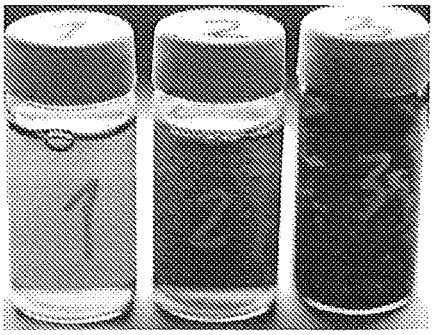
FIG. 23 shows HCl/NaCl solutions from test 1, 2, and 3 of Table 9, showing the precipitation of $FeCl_2$ observed in test 2 and 3.

Table 18 shows the estimated pH for the used chloride solutions based on consumed $H^+$. Iron is partly present as dissolved $Fe^{2+}$, and partly precipitated as $FeCl_2$. The solubility of $FeCl_2$ in the solution is not known. FIG. 23 shows precipitation of $FeCl_2$ after 4 hours exposure in accordance with the third aspect of the present invention (samples labelled 2 and 3). Generally, the amount of precipitates present seems to increase with increasing exposure time.

TABLE 18

| Compounds | Concentration [g/l] | $[H^+]_{used}$ | Concentration [mole/l] | pH = − Log [$H^+$] |
|---|---|---|---|---|
| 20 wt % HCl | 220 | | 6.02 | |
| 5 wt % NaCl | 50 | | 0.86 | |
| [$Cl^-$] = [HCl] + [NaCl] | | | 6.88 | |
| [$Na^+$] = [NaCl] | | | 0.86 | |
| $Fe_{diss}$ = [$Fe^{2+}$] | Solubility of $FeCl_2$ in the HCl/NaCl solution is not known. | | | |
| [$Fe^{2+}$] + 2 [$Cl^-$] = $FeCl_2$ | Visual evaluation of test solutions show that solids are present | | | |
| [$H^+$]~[HCl] | | 0 | 6.02 | −0.78 |
| [$H^+$]~[HCl] − $[H^+]_{used}$ | | 2.38 | 3.64 | −0.56 |
| | | 3.63 | 2.39 | −0.38 |
| | | 5.03 | 0.99 | 0.0029 |
| | | 5.50 | 0.52 | 0.28 |
| Kw = [$H^+$] · [OH−] = $10^{-14}$ | [$OH^-$] = $10^{-14}$/[$H^+$]; [$OH^-$] << [$H^+$] | | | |
| Electron neutrality—EN | [$H^+$] + [$Na^+$] + [$Fe^{2+}$] = [$Cl^-$] + [$OH^-$]~[$Cl^-$] | | | |

Figure 22:
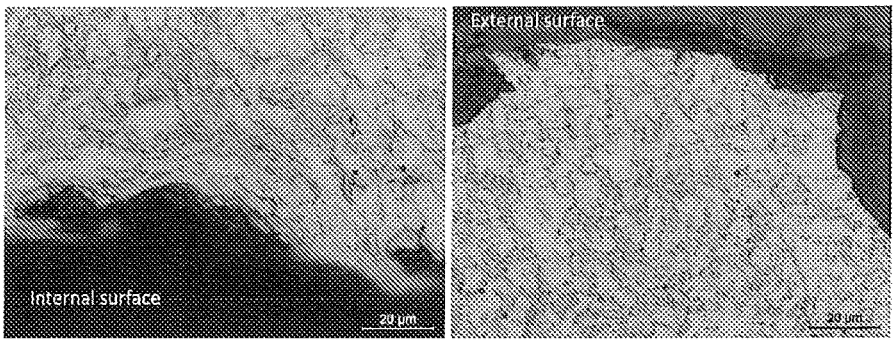
FIG. 22 shows micrographs of the microstructure through an L80 pipe wall in positions at internal and external surfaces after dissolution testing according to the third aspect of the present invention.

The micrographs shown in FIG. 21 indicate microstructural differences between the middle of the pipe wall and external and internal surfaces. Apparently, grain sizes in the surface are larger particularly in the internal surface as shown in FIG. 22. The difference is depending on to the production process of the seamless pipes. The external surfaces are removed by grinding. Hence, the longitudinal etching in internal surfaces of the exposed samples is probably due to the microstructure.

Acidity of the HCl/NaCl Solutions

HCl is a strong acid which is completely dissociated into $H^+$ and or ions. In a 20 wt % HCl solution we assume that 5 wt % NaCl is entirely dissolved. Hence, the pH in the start solution was estimated to be −0.78, as shown in Table 16.

13Cr L80

When 13 Cr L80 is exposed to the HCl/NaCl solution, Cr is dissolved in addition to Fe:

$$Cr+2H^+=Cr^{2+}+H_2$$

The density used for 13Cr L80 was $d_{13Cr}$=0.989 $d_{steel}$ in accordance to API Specification 5CT/ISO 11960:2001. The results of dissolution testing determined gravimetrically from weight loss data of 13Cr L80 steel samples in 20 wt % HCl+5 wt % NaCl solutions at 90° C. are summarized in Table 19.

TABLE 19

| Electrolyte: 20% HCl + | Test no | Exposure time [hours] | Average temperature [° C.] | Average steel thickness removal [mm] | Average dissolution rate [mm/day] |
|---|---|---|---|---|---|
| 5% NaCl | 11 | 2.0 | 88 | 0.98 ± 0.03 | 11.6 ± 0.3 |
| 5% NaCl | 13 | 4.0 | 90 | 1.08 ± 0.01 | 6.5 ± 0.3 |
| 5% NaCl | 10 | 4.1 | 90 | 1.13 ± 0.02 | 7.1 ± 0.1 |
| 5% NaCl | 14 | 8.0 | 89 | 1.18 ± 0.03 | 7.1 ± 0.1 |

Figure 24:
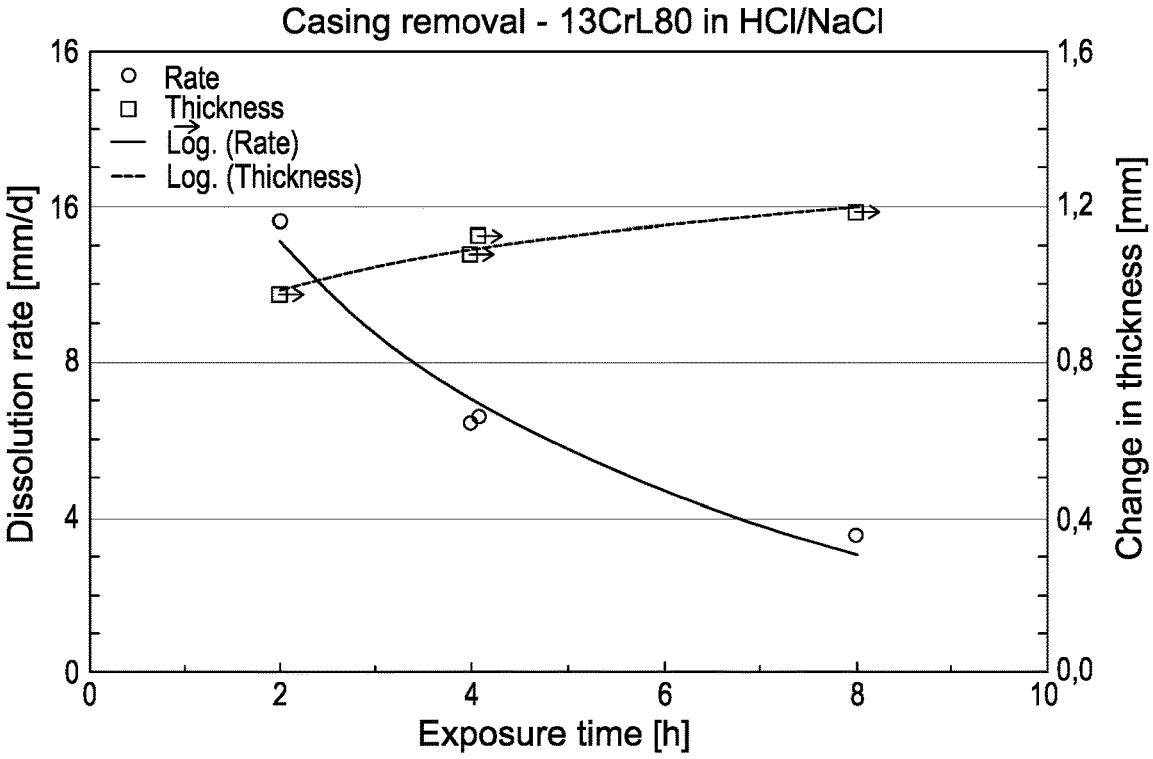
FIG. 24 shows a plot of the dissolution rate and change in steel thickness as function of exposure time of 13Cr L80 steel in 20 wt % HCl+5 wt % NaCl at 90° C. in an experiment performed according to the third aspect of the present invention.
Figure 25:
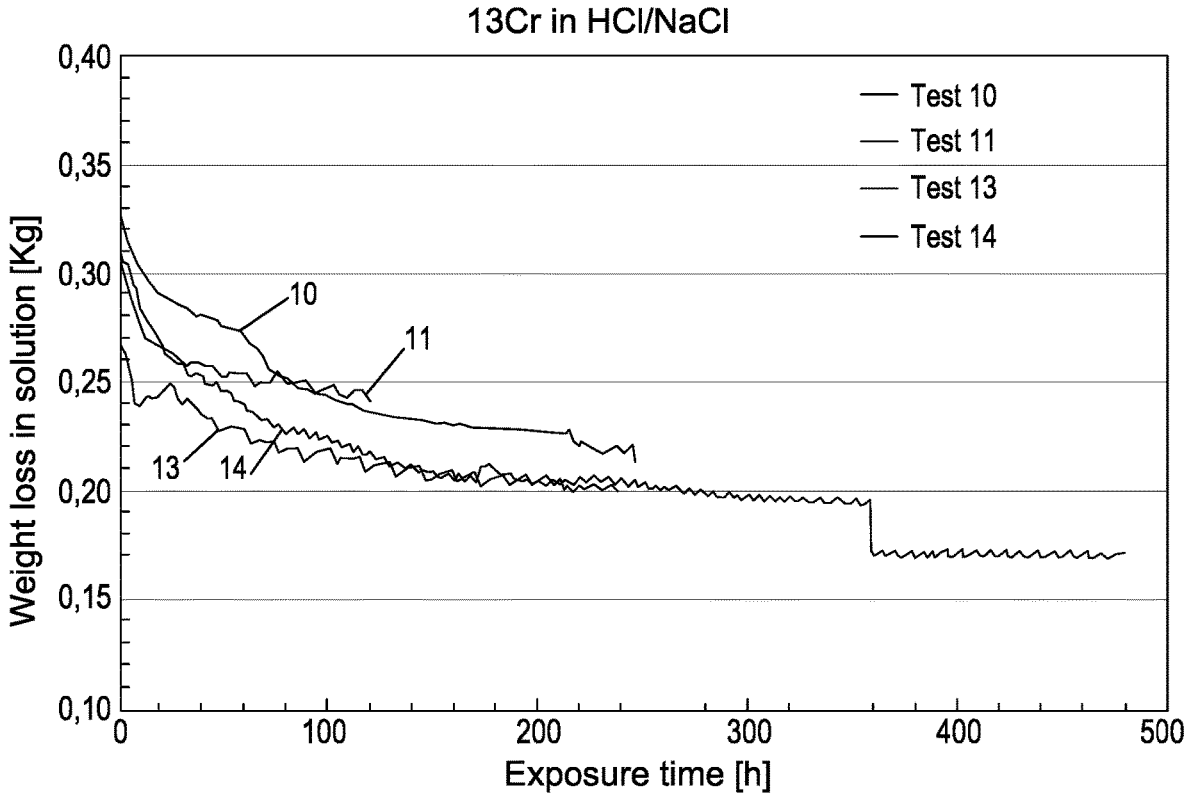
FIG. 25 shows a plot of continuous weight loss measurements for dissolution testing of 13Cr L80 steel in NaCl/HCl solutions at 90° C. in an experiment performed according to the third aspect of the present invention.

FIG. 24 shows the dissolution rate and the change in steel pipe thickness determined from weight loss data for test samples as functions of exposure time. $H_2$ gas evolution determined gravimetrically from weight loss data are shown in Table 20. Weight changes measured continuously for one sample in each test are shown in FIG. 25.

TABLE 20

| | Dissolution testing steel 13CrL80 | | | | Amount $H_2$ produced | | | |
|---|---|---|---|---|---|---|---|---|
| | | | | | | | 9⅝ × 8½ casing | |
| | Exposure time | Temperature | Fe and Cr in solution | | Lab test | | 67.8 $m^2$ per 100 m length | |
| Test | [h] | [° C.] | [g/l] | [mol/l] | [mol/l, h] | [mol/$dm^2$, h] | mol/h | $m^3$/h |
| TEST 11 | 2.00 | 90 | 143 | 2.58 | 1.29 | 0.70 | 4728 | 116 |
| TEST 10 | 4.08 | 88 | 165 | 2.98 | 0.73 | 0.39 | 2678 | 66 |
| TEST 13 | 4.00 | 90 | 158 | 2.86 | 0.71 | 0.39 | 2615 | 64 |
| TEST 14 | 8.00 | 89 | 173 | 3.13 | 0.39 | 0.21 | 1433 | 35 |

The results show high initial dissolution rates for 13Cr L80 compared to L80 carbon steel. This is because the strong acid promotes fast dissolution of the Cr-oxide film which is usually present as a passivation layer on Cr steel. The presence of bare Cr metal, which is less noble than Fe, is probably the reason for the high initial dissolution rate of this 13Cr alloy.

The results show that 0.98 mm of the material thickness was removed after 2 hours exposure. The dissolution rate, however, decreased quickly with increasing time, and between 2 and 4 hours exposure in the same solution just 0.1 mm of the material thickness was removed. Little or no steel seemed to dissolve in the chloride solution beyond 4 hours' exposure. Compared to the L80 samples, the 13Cr L80 steel samples seemed to be less affected by localised etching in holes and along sample edges.

Figure 26:
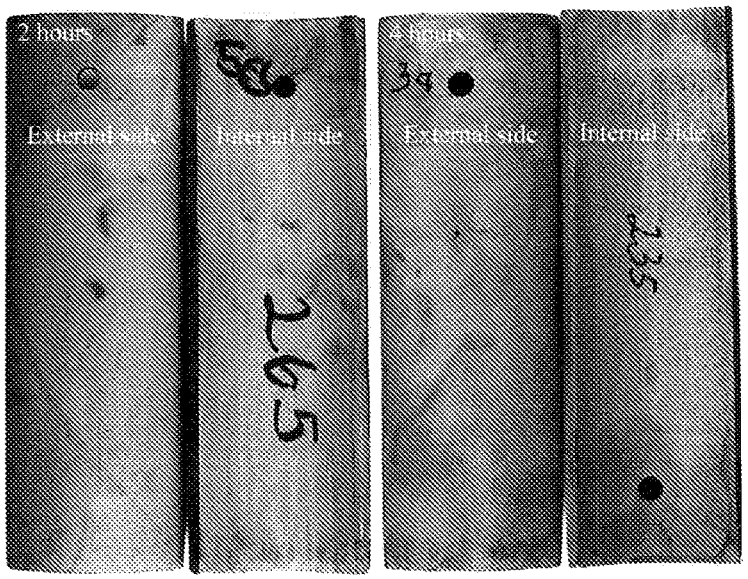
FIG. 26 shows 13Cr L80 samples that were exposed for 2 and 4 hours in the HCl/NaCl test solution in an experiment performed according to the third aspect of the present invention.

Pictures of exposed 13Cr L80 steel samples exposed 1 and 4 hours in the test solutions are shown in FIG. 26. Mill scales were removed on both sides of the samples by grinding prior to exposure. The latter may explain that also the internal side of the samples had a uniform surface appearance after exposure.

The results of the gravimetric analysis were verified by inductively coupled plasma (ICP) analysis, as shown in Table 21.

TABLE 21

| Electrolyte: 20% HCl + | Test no | Exposure time [hours] | Average temperature [° C.] | Average steel thickness removal [mm] | Average dissolution rate [mm/day] |
|---|---|---|---|---|---|
| 5% NaCl | 11 | 2.0 | 88 | 0.98 ± 0.03 | 11.6 ± 0.3 |
| 5% NaCl | 13 | 4.0 | 90 | 1.08 ± 0.01 | 6.5 ± 0.3 |
| 5% NaCl | 10 | 4.1 | 90 | 1.13 ± 0.02 | 7.1 ± 0.1 |
| 5% NaCl | 14 | 8.0 | 89 | 1.18 ± 0.03 | 7.1 ± 0.1 |

It can be seen that the sum of analysed Fe and Cr content in the samples are 6-13% higher than the gravimetric weight loss data indicated. The higher values are due to evaporation from the HCl/NaCl solutions after ending the tests, as explained for dissolution testing of L80 above. The ICP data showed that the relative content of Cr compared to Fe in the test solutions varied between 12.1 and 14.7%, which confirms the uniform etching of the 13Cr L80 alloy.

Comparison of L80 and 13Cr L80 Dissolution Rates in HCl/NaCl

Table 22 compares dissolution rates obtained for 13Cr L80 and L80 in the tests performed. The results are similar to published data corrosion of steel in 15 wt % HCl at temperatures up to 100° C. (al, M.A.M.M.e., *TEMPERATURE DEPENDENCE OF CORROSION INHIBITION OF STEELS USED IN OIL WELL STIMULATION USING ACETYLENIC COMPOUND AND HALIDE ION SALT MIXTURES*. Brazilian J. of Petroleum and Gas, 2007. 1(1): p. 8-15). Temperature and acid concentration/pH are both decisive for the observed dissolution rates.

TABLE 22

| Exposure time | Average dissolution rate L80 | | Exposure time | Average dissolution rate 13CrL80 | |
|---|---|---|---|---|---|
| [hours] | [mm/day] | [mm/yr] | [hours] | [mm/day] | [mm/yr] |
| 20 | 1.1 | 402 | | | |
| 8 | 3.4 | 1241 | 8 | 7.1 | 2592 |
| 4 | 4.4 | 1606 | 4 | 6.5 | 2373 |
| 2.1 | 5.6 | 2044 | 2 | 11.6 | 4234 |

$H_2$ gas evolution is a combined effect of Fe and Cr dissolution. The amount of $H_2$ gas produced in the lab tests has been calculated based on the assumption that the $^{13}$Cr L80 alloy consists of 13 wt % Cr and 87 wt % Fe and is shown in Table 23.

TABLE 23

| Dissolution testing steel 13CrL80 | | | | | Amount $H_2$ produced | | | |
|---|---|---|---|---|---|---|---|---|
| | | | | | | | 9⅝ × 8½ casing | |
| | Exposure time | Temperature | Fe and Cr in solution | | Lab test | | 67.8 m$^2$ per 100 m length | |
| Test | [h] | [° C.] | [g/l] | [mol/l] | [mol/l, h] | [mol/dm$^2$, h] | mol/h | m$^3$/h |
| TEST 11 | 2.00 | 90 | 143 | 2.58 | 1.29 | 0.70 | 4728 | 116 |
| TEST 10 | 4.08 | 88 | 165 | 2.98 | 0.73 | 0.39 | 2678 | 66 |
| TEST 13 | 4.00 | 90 | 158 | 2.86 | 0.71 | 0.39 | 2615 | 64 |
| TEST 14 | 8.00 | 89 | 173 | 3.13 | 0.39 | 0.21 | 1433 | 35 |

The lab test data was used to determine $H_2$ gas evolution in 100 m of a 9⅝"×8½" casing pipe. The results indicate that the average $H_2$ gas evolution rate of $^{13}$Cr L80 after 2 hours exposure in 20 wt % HCl containing 5 wt % NaCl will be about 116 m$^3$/hour, which is more than the double the $H_2$ evolution determined for L80 steel under the same environmental conditions.

Dissolution Testing of L80 Steel in Phosphonic Acid

The results of dissolution testing determined gravimetrically from weight loss data of L80 steel samples in phosphonic acid ($H_3PO_3$) at 20 and 90° C. are shown in Table 24.

TABLE 24

| Test solution | Test no | Exposure time [hours] | Average temperature [° C.] | Average steel thickness removal [mm] | Average dissolution rate [mm/day] |
|---|---|---|---|---|---|
| 1M $H_3PO_3$ | 15 | 2.0 | 89 | 0.23 ± 0.01 | 2.8 ± 0.1 |
| 2M $H_3PO_3$ | 16 | 2.0 | 89 | 0.43 ± 0.01 | 5.1 ± 0.1 |
| 2M $H_3PO_3$ | 17 | 4.1 | 89 | 0.45 ± 0.00 | 2.63 ± 0.03 |
| 2M $H_3PO_3$ | 18 | 4.0 | 20 | 0.01 ± 0.00 | 0.03 ± 0.03 |

Figure 27:
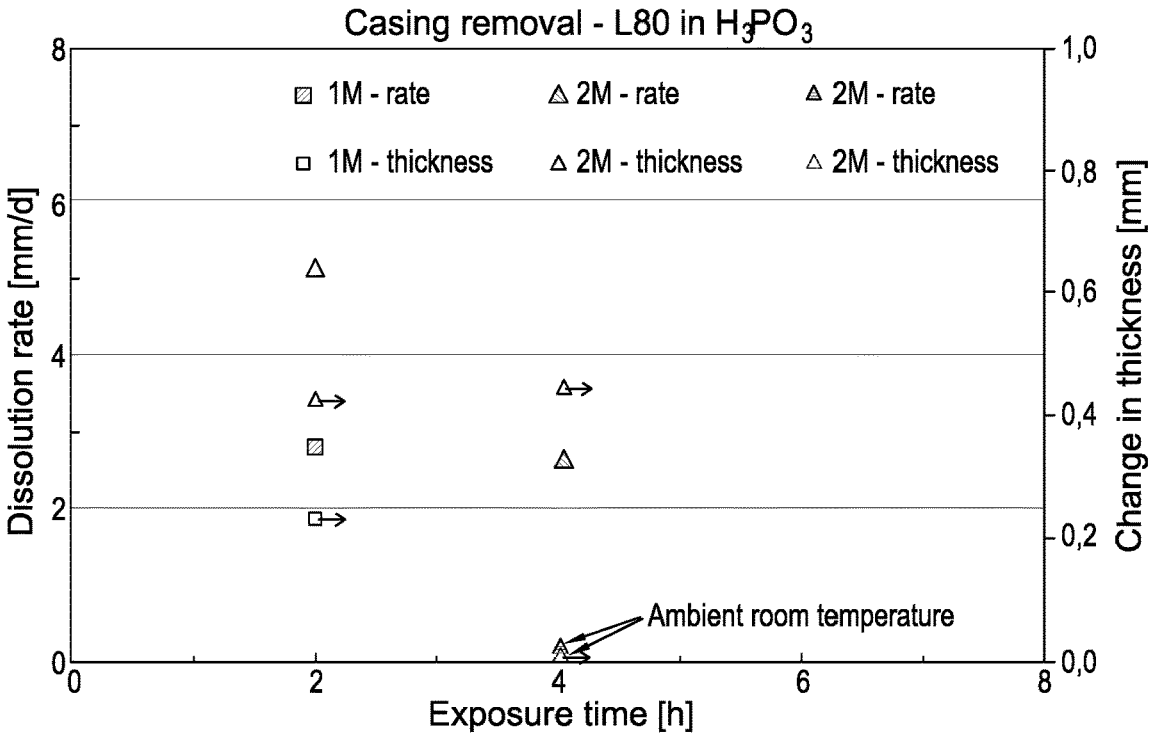
FIG. 27 shows a plot of continuous weight loss measurements for dissolution testing according to the third aspect of the present invention of L80 steel in phosphonic acid at 20 and 90° C.

FIG. 27 shows the dissolution rate and the change in steel pipe thickness as functions of exposure time and $H_3PO_3$ concentration.

Figure 28:
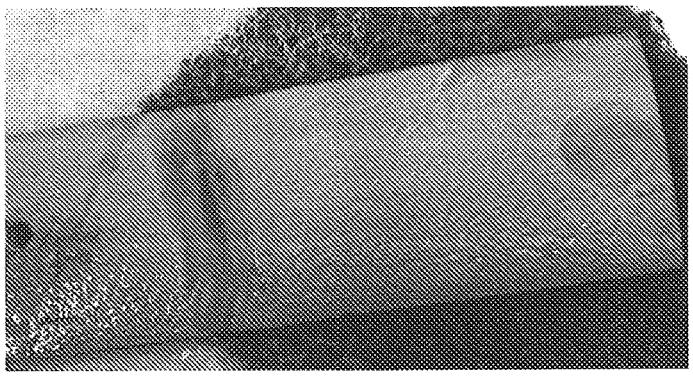
FIG. 28 shows an L80 sample with white, non-adhering precipitates at the steel surface formed after 4 hours exposure in 4M $H_3PO_3$ at 90° C. in accordance with the third aspect of the present invention.
Figure 29:
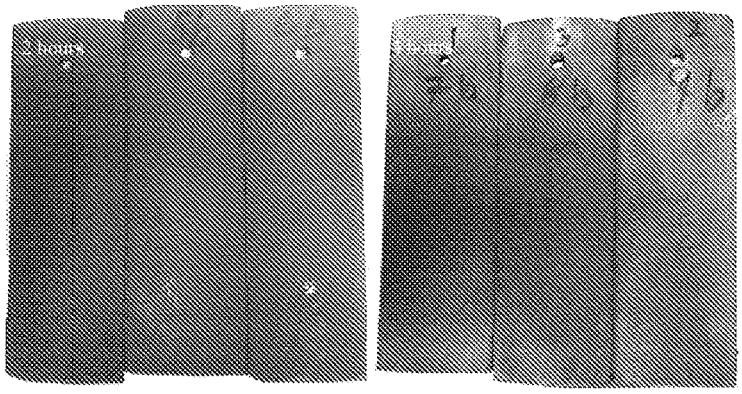
FIG. 29 shows L80 samples exposed for 2 and 4 hours in 2M $H_3PO_3$ in accordance with the third aspect of the present invention.

As the results of dissolution testing in Table 24 and FIG. 27 show, surprisingly high dissolution rates were found in the weak diprotic phosphonic acid. After 2 hours exposure in a 1M $H_3PO_3$ solution at 90° C., 0.23 mm of the material thickness was removed. By doubling the $H_3PO_3$ acid concentration, the steel removal after 2 hours exposure was approximately doubled (0.43 mm). By increasing the exposure period in the 2M solution from 2 to 4 hours only a minor increase in steel removal (from 0.43 to 0.45 mm) was observed. Evaluation of exposed samples showed that precipitates had settled at the steel surface after 4 hours exposure, as shown by FIG. 28. The precipitates were easily removed when rinsing the steel samples under tap water. A uniform surface appearance was seen after removing the precipitates. FIG. 29 shows samples exposed 2 and 4 hours in the 2M $H_3PO_3$ at 90° C.

Only minor etching was observed after 4 hours dissolution testing in 2M $H_3PO_3$ at ambient room temperature (0.01 mm steel removal). The continuous weight change measurement in FIG. 27 also confirms that the dissolution rate is close to zero after less than 4 hours exposure.

Table 25 shows the pH of test solutions before and after dissolution testing.

TABLE 25

| | pH in test solutions | | |
|---|---|---|---|
| Test solution | Calculated[1] | Measured prior to testing | Measured after 2 h dissolution testing |
| 1M $H_3PO_3$ | 0.7 | 0.5-1-0 | 1.9-2.2 |
| 2M $H_3PO_3$ | 0.53 | ca 0.5 | 1.6-1.9 |

[1]http://www.endmemo.com/chem/phcal.php

As shown in Table 25, the pH increased fast due to steel dissolution. Temperature and acid contents/pH are decisive for steel removal in phosphonic acid.

Weight change measured continuously for one sample in each test is shown in FIG. 27. $H_2$ gas evolution determined gravimetrically from weight loss is shown in Table 26.

TABLE 26

| Dissolution testing steel L80 in $H_3PO_3$ | | | | | Amount $H_2$ produced | | | |
|---|---|---|---|---|---|---|---|---|
| | | | | | | | 9⅝ × 8½ casing | |
| | Exposure time | Temperature | Fe and Cr in solution | | Lab test | | 67.8 $m^2$ per 100 m length | |
| Test | [h] | [° C.] | [g/l] | [mol/l] | [mol/l, h] | [mol/dm$^2$, h] | mol/h | $m^3$/h |
| TEST 15-1M | 2.00 | 89 | 32.30 | 0.58 | 0.29 | 0.16 | 1059 | 26 |
| TEST 16-2M | 2.00 | 89 | 59.03 | 1.06 | 0.53 | 0.29 | 1935 | 47 |
| TEST 17-2M | 4.05 | 89 | 61.48 | 1.10 | 0.27 | 0.15 | 995 | 24 |
| TEST 18-2M | 4.02 | 20 | 1.40 | 0.03 | 0.01 | 0.00 | 23 | 1 |

As can be seen from Table 26, $H_2$ gas evolution estimated from weight loss data of L80 steel samples in $H_3PO_3$ at 90° C. are used to determine $H_2$ in a 9⅝"×8½" casing exposed at similar conditions. The results indicate an average $H_2$ gas evolution rate of 26 and 47 $m^3$/hours in the first 2 hours of exposure in 1M and 2M $H_3PO_3$ solutions, respectively. The initial $H_2$ gas evolution in the 2M solution is similar to the gas evolution rate determined for L80 casing removal in 20 wt % HCl containing 5% NaCl.

Analysis of the Fe content of the samples of the used $H_3PO_3$ solutions are compared to Fe contents determined from the weight loss measurements in Table 27.

Dissolution testing showed that approximately 1 mm of 13Cr L80 tubing can be removed within 2 hours in a HCl based solution while approximately 8 hours are needed to remove 1 mm of L80 casing pipe. Exposure in phosphonic acid showed that 0.23 mm of L80 casing pipe can be removed within 2 hours in 1M H3PO3. By doubling the acid content (to 2M) steel removal increased to 0.43 mm. L80 casing pipe material showed minor dissolution rates at ambient room temperature: 0.03 and 0.06 mm of the material was removed after 4 hours in the HCl and $H_3PO_3$ solutions, respectively.

TABLE 27

| | | | Average | Fe in solution | | | |
|---|---|---|---|---|---|---|---|
| | | Exposure time | temperature | Determined | Analysis Molab | | Difference [%] |
| Test no | Test solution | [hours] | [° C.] | [g/l] | [% Fe løst] | [g/l] | analysed/determined |
| 15 | 1M $H_3PO_3$ | 2.0 | 89 | 32.30 | 3.4 | 34 | 5.3 |
| 16 | 2M $H_3PO_3$ | 2.0 | 89 | 59.03 | 6.7 | 67 | 13.5 |
| 17 | 2M $H_3PO_3$ | 4.1 | 89 | 61.48 | 4.4 | 44 | −28.4 |

Two of the analysed values were higher than the Fe contents determined gravimetrically from weight loss. As discussed above, this is due to evaporation after ending the dissolution test. The low content of Fe found by ICP analysis of the sample from test 17, however, is difficult to understand.

SUMMARY

The examples performed according to the first aspect of the present invention (see the results in Tables 1 to 11) show that high chemical dissolution rates of carbon steel are achieved by exposure of steel tubes in 20% HCl and 20% $H_2SO_4$ test solutions at 60° C. and flowing in the range 0.05-0.2 m/s. The dissolution rates are particularly high in $H_2SO_4$. Addition of NaCl resulted in increased dissolution rate in HCl while the opposite effect was found for the $H_2SO_4$ based solution. Based on the steel dissolution rates determined in the lab tests a 9⅝"×8½" casing may be removed within less than 10 days.

The examples performed according to the third aspect of the present invention (see the results in Tables 12 to 27) show that high chemical dissolution rates of steels are achieved by exposure of steel tubes in 20% HCl and 1M or 2M $H_3PO_3$ solutions at temperatures of around 90° C.

The invention claimed is:

1. A method of chemically removing iron-containing casing from a well bore comprising:

(i) injecting an acidic solution into said well bore, wherein said acidic solution contacts said iron-containing casing and thereby accelerates oxidation of iron to iron cations;

(ii) allowing said iron cations to dissolve in said acidic solution;

(iii) removing said acidic solution from said well bore;

(iv) separating iron ions and hydrogen from said acidic solution; and (v) reinjecting said acidic solution removed from said well bore into said well bore.

2. A method as claimed in claim 1, which removes said iron-containing casing from a selected interval of said well bore.

3. A method as claimed in claim 2, wherein said well bore is temporarily plugged above and temporarily or permanently plugged below said selected interval of said well bore.

4. A method as claimed in claim 1, wherein said acidic solution is delivered into, and removed from, said well bore via a dual fluid line.

5. A method as claimed in claim 1, wherein said method is continuous.

6. A method as claimed in claim 1, wherein said iron-containing casing comprises steel.

7. A system for removing iron-containing casing from a well bore comprising:

(i) a well bore comprising an iron-containing casing;

(ii) a first fluid line for injecting an acidic solution into said well bore;

(iii) a second fluid line for removing said acidic solution from said well bore;

(iv) a tank comprising said acidic solution; and (v) a separation system for separating iron ions and hydrogen from said acidic solution; wherein said tank is fluidly connected to said first fluid line;

said second fluid line is fluidly connected to said separation system; and said separation system is fluidly connected to said tank.

8. A system as claimed in claim 7, wherein said well bore comprises temporary plugs above and temporary or permanent plugs below the interval from which the iron-containing casing is to be removed.

9. A system as claimed in claim 7, wherein said separation system comprises a means for monitoring and/or measuring the amount of hydrogen removed from said acidic solution.

10. A method for monitoring the removal of an iron-containing casing from a well bore comprising:

(i) carrying out a chemical method for removing iron-containing casing from a well bore as claimed in claim 1 wherein $H_2$ gas is liberated in the process;

(ii) determining the amount of hydrogen liberated in the process; and (iii) determining the amount of iron-containing casing dissolved.

11. A method of plugging and abandoning a well comprising;

(i) carrying out a method as claimed in claim 1.

12. A method as claimed in claim 11, further comprising sealing said well.

13. A method of removing iron-containing casing from a well bore comprising:

(i) injecting an acidic solution into said well bore, wherein said acidic solution contacts said iron-containing casing and thereby accelerates oxidation of iron to iron cations;

(ii) allowing said iron cations to dissolve in said acidic solution;

(iii) removing said acidic solution from said well bore; and (iv) separating iron ions and hydrogen from said acidic solution;

wherein said well bore is at least partially open to the atmosphere for the duration of step (ii).

14. A method as claimed in claim 13, which removes said iron-containing casing from a selected interval of said well bore.

15. A method as claimed in claim 14, wherein said acidic solution is moved from said selected interval of said well bore to another interval within the well bore after allowing said iron cations to dissolve in said acidic solution.

16. A method as claimed in claim 14, wherein a pill of a viscous or dense fluid is placed above and/or below said interval to prevent the acidic solution from mixing with fluids above and/or below said acidic solution in said well bore.

17. A method as claimed in claim 14, wherein said well bore is temporarily plugged above and temporarily or permanently plugged below said selected interval of said well bore.

18. A method as claimed in claim 13, wherein a further solution is injected into said well bore after allowing said iron cations to dissolve in said acidic solution.

19. A method as claimed in claim 13, wherein a fluid is produced by contact of said acidic solution with said iron-containing casing.

20. A method as claimed in claim 19, wherein at least a portion of said fluid is removed from the well bore.

21. A method as claimed in claim 20, wherein at least a portion of said fluid is removed by venting.

22. A method as claimed in claim 19, wherein at least a portion of said fluid is removed by displacement out of said well bore.

23. A method as claimed in claim 19, wherein at least a portion of said fluid is removed by a downhole absorption or adsorption medium present in said well bore.

24. A method as claimed in claim 19, wherein said fluid is a gas.

25. A method as claimed in claim 13, further comprising (v) reinjecting said acidic solution into said well bore.

26. A method as claimed in claim 13, wherein each of steps (i) and (ii) are sequentially repeated a plurality of times.

27. A method as claimed in claim 13, further comprising the step of:

(vii) removing said iron-containing casing by milling.

28. A method for removing iron-containing casing from a well bore as claimed in claim 13, further comprising the steps:

(i) providing a cathode in said well bore, wherein said cathode is connected to the negative pole of a power source;

(ii) connecting said iron-containing casing to the positive pole of said power source;

(iii) injecting an electrolyte into said well bore, wherein said electrolyte contacts said iron-containing casing and said cathode;

(iv) applying a current so that the iron in said iron-containing casing is oxidised to iron cations;

(v) allowing said iron cations to dissolve in said electrolyte; and (vi) removing said electrolyte from said well bore.

29. A method as claimed in claim 28, wherein the exterior surface of a fluid line forms the cathode.

30. A method as claimed in claim 13, wherein said iron-containing casing comprises steel.

31. A method of plugging and abandoning a well comprising;

(ii) carrying out a method as claimed in claim 13.

32. A method as claimed in claim 31, further comprising sealing said well.

* * * * *